US006450603B1

(12) United States Patent
Chang

(10) Patent No.: US 6,450,603 B1
(45) Date of Patent: Sep. 17, 2002

(54) DRIVER FOR INK JET RECORDING HEAD

(75) Inventor: Junhua Chang, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/329,345

(22) Filed: Jun. 10, 1999

(30) Foreign Application Priority Data

| | | |
|---|---|---|
| Jun. 10, 1998 | (JP) | 10-162305 |
| Feb. 5, 1999 | (JP) | 11-028667 |
| May 6, 1999 | (JP) | 11-126079 |
| Jun. 9, 1999 | (JP) | 11-162676 |

(51) Int. Cl.[7] ..... B41J 29/38
(52) U.S. Cl. ..... 347/10; 347/11
(58) Field of Search ..... 347/9, 10, 11, 347/68

(56) References Cited

U.S. PATENT DOCUMENTS

| | | | | |
|---|---|---|---|---|
| 5,285,215 A | | 2/1994 | Liker | 347/11 |
| 6,283,568 B1 | * | 9/2001 | Horii et al. | 347/10 |

FOREIGN PATENT DOCUMENTS

| | | | | |
|---|---|---|---|---|
| EP | 0 738 602 | | 10/1996 | B41J/2/045 |
| EP | 0 765 750 | | 4/1997 | B41J/2/045 |
| EP | 0 788 882 A2 | * | 8/1997 | B41J/2/04 |
| EP | 0 827 838 | | 3/1998 | B41J/2/21 |
| JP | 4-15735 | | 3/1992 | B41J/2/205 |
| JP | 9-226116 | * | 9/1997 | B41J/2/045 |
| JP | 10-109433 | * | 4/1998 | B41J/2/205 |
| JP | 11058719 A | * | 3/1999 | B41J/2/01 |

* cited by examiner

*Primary Examiner*—John Barlow
*Assistant Examiner*—Alfred Dudding
(74) *Attorney, Agent, or Firm*—Sughrue Mion, PLLC

(57) ABSTRACT

An ink jet recording apparatus comprises a recording head including a pressure generating element provided in association with a pressure generating chamber communicating with a nozzle orifice, an ink drop is jetted from the nozzle orifice by applying a drive pulse to the pressure generating element, drive signal generating means for generating a drive signal, and drive pulse generating means for generating a drive pulse from the drive signal. The drive signal generated by the drive signal generating means contains wave elements capable of activating the pressure generating element and a connection element incapable of activating the pressure generating chamber and for connecting connection ends of the wave elements having different voltage levels. The drive pulse generating means appropriately selects the wave elements in the drive signal and composes them into the drive pulse.

29 Claims, 20 Drawing Sheets

FIG. 4(a)
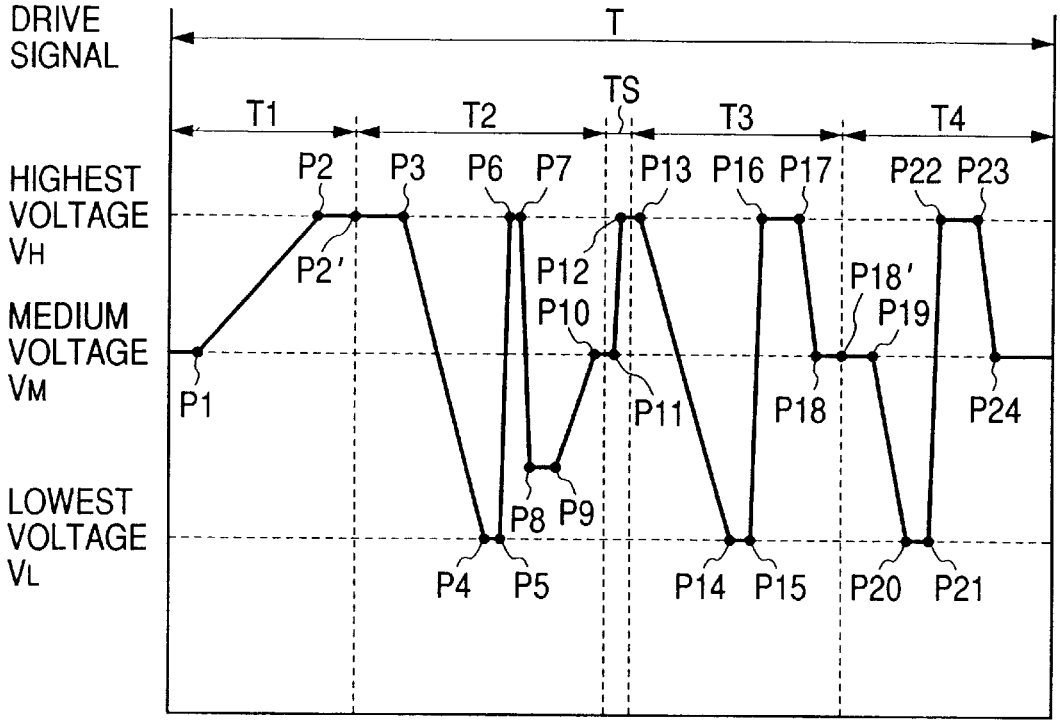
FIG. 4(b)
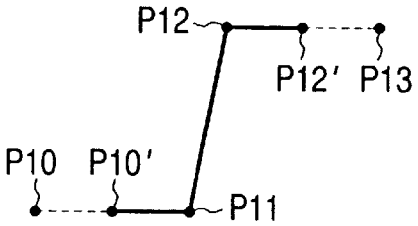
FIG. 4(c)
| | GRADATION VALUE | DECODED VALUE (PRINT DATA) |
|---|---|---|
| NO PRINT | 00 | 00000 |
| SMALL DOT | 01 | 11000 |
| MEDIUM DOT | 10 | 10010 |
| LARGE DOT | 11 | 10011 |

DRIVER FOR INK JET RECORDING HEAD

BACKGROUND OF THE INVENTION

The present invention relates to an ink jet recording apparatus which is capable of ejecting ink drops of different volumes through the same nozzle orifice, and more particularly to a method of driving an ink jet recording head of the ink jet recording apparatus.

The ink jet recording apparatus is composed of a recording head having linear arrays of nozzle orifices, a carriage mechanism for moving the recording head in the main scanning direction (a width direction of a recording paper), and a paper feeding mechanism for moving a recording paper in the subscanning direction (paper feeding direction).

The recording head includes pressure generating chambers communicated to the nozzle orifices, and pressure generating elements for varying ink pressures within the pressure generating chambers. In operation, a drive pulse is applied to each pressure generating element to vary an ink pressure in the associated pressure generating chamber, so that an ink drop is jetted from the related nozzle orifice.

The carriage mechanism moves the recording head in the main scanning direction. The recording head ejects ink drops through the nozzle orifices at times determined by dot pattern data, while moving in the main scanning direction. When the moving recording head reaches the terminal end of its moving range, the paper feeding mechanism moves a recording paper in the subscanning direction. Upon end of the recording paper movement, the carriage mechanism moves again the recording head in the main scanning direction. The recording head ejects ink drops while moving.

Repeating the above sequence of operations, the recording head records an image represented by dot pattern data on a recording paper.

The ink jet recording apparatus depicts an image on a recording paper by combinations of ejection and non-ejection of ink, viz., combinations of presence and absence of dots. For this reason, a half-tone method has been used in which one pixel is formed by a plurality of dots, for example, 4×4 or 8×8 dots. To print or visually recording an image at high quality on the recording paper by the half-tone method, it is essential to eject ink drops of extremely small volumes. Reduction of the volume of the ink drop creates another problem of reducing printing speed.

Achieving of the improvement of the print quality and increase of the printing speed is one of the important technical subjects currently imposed on engineers. There are some technical solutions, so far as we know, to this contradictory subject.

In the solution disclosed in, for example, Japanese Patent Publication No. 4-15735B and U.S. Pat. No. 5,285,215, a plurality of drive signal capable of generating fine ink drops are applied to the recording head. In turn, the recording head ejects a plurality of fine ink drops through the same nozzle orifice. In this case, the fine ink drops jetted are merged into a single large ink drop before those fine ink drops land on a recording paper.

The technical solution involves some problems to be solved, however. The number of fine ink drops that may be merged is limited. The result is that the volume of one ink drop, which results from the ink drop merging, may be increased with a limited ink volume and within a narrow range where the ink volume is variable. Further, control for merging fine ink drops into one large ink drop before they land on the recording paper is difficult.

A technical proposal is made in this connection. In the technique, a drive signal consisting of a succession of different drive pulses, which correspond to the volumes of fine ink drops to be jetted, is generated, and the drive pulses extracted from the drive signal are applied to the pressure generating element.

In the solution disclosed in the publications, mere connection of different drive pulses will create the following problems.

A first problem is that a drive period required for printing one dot is long. It is necessary to connect the number of drive pulses corresponding to the number of the different volumes of ink drops. The drive period is increased with increase of the number of drive pulses connected. The increase of the drive period leads to decrease of the printing speed.

A second problem is that the flying velocity of the ink drop depends on the volume of the ink drop. When comparing a large ink drop for forming a large dot with a medium ink drop for forming an medium dot, the flying velocity of the large ink drop is higher than that of the medium ink drop. Increase of the ink-volume difference leads to increase of the flying velocity difference. The flying velocity difference causes an incorrect landing position of the ink drop, resulting in degradation of the print quality.

SUMMARY OF THE INVENTION

The present invention is made to successfully solve the problems described above, and has an object to efficiently confine an increased number of drive pulses, which are capable of ejecting ink drops of different volumes, within a limited drive period.

Another object of the present invention is to lessen the flying velocity difference caused by the volume difference among the ink drops.

In order to achieve the above objects, according to a first aspect of the present invention, there is provided an ink jet recording apparatus comprising: a recording head including a pressure generating element provided in association with a pressure generating chamber communicating with a nozzle orifice, an ink drop is jetted from the nozzle orifice by applying a drive pulse to the pressure generating element; drive signal generating means for generating a drive signal; and drive pulse generating means for generating a drive pulse from the drive signal; wherein the drive signal generated by the drive signal generating means contains wave elements capable of activating the pressure generating element and a connection element incapable of activating the pressure generating chamber and for connecting connection ends of the wave elements having different voltage levels, and wherein the drive pulse generating means appropriately selects the wave elements in the drive signal and composes them into the drive pulse.

According to a second aspect of the. present invention, in the ink jet recording apparatus of the first aspect, the time period of the voltage-gradient portion of the connection element is not longer than that of the wave elements.

According to a third aspect of the present invention, in the ink jet recording apparatus of the first or second aspect, the wave elements include a plurality of ejection wave elements capable of driving the pressure generating element to eject an ink drop. The connection element interconnects the ejection wave elements.

According to a fourth aspect of the present invention, in the ink jet recording apparatus of the third aspect, the wave elements include a filling wave element capable of driving the pressure generating element to fill ink into the pressure generating chamber. The drive pulse generating means generates a plurality kinds of drive pulses at the time of selecting the ejection wave element and the filling wave element.

According to a fifth aspect of the present invention, in the ink jet recording apparatus of the first to fourth aspects, the wave elements include a plurality of ejection wave elements capable of driving the pressure generating element to eject ink drops at different timings. The drive pulse generating means generates a plurality of drive pulses such that an ink drop forming a small-volume dot is ejected earlier than an ink drop forming a large-volume dot.

According to a sixth aspect of the present invention, in the ink jet recording apparatus of the first to fourth aspects, the wave elements include a plurality of ejection wave elements capable of driving the pressure generating element to eject ink drops at different timings. The drive pulse generating means generates a small-dot drive pulse capable of ejecting a small-volume ink drop to form a small dot, a medium-dot drive pulse capable of ejecting a medium ink drop to form a medium-volume dot, and a large-dot drive pulse capable of ejecting a large ink drop to form a large-volume dot. Either one of ejection wave elements of large- or medium-dot drive pulses is located before an ejection wave element of a small-dot drive pulse on the time axis, and the other one is located after an ejection wave element of a small-dot drive pulse on the time axis.

According to a seventh aspect of the present invention, in the ink jet recording apparatus of the first to fourth aspects, the wave elements include first and second large-dot ejection wave elements capable of forming a large-volume dot, and an other-dot ejection wave element for ejecting an ink drop to form a dot having a size other than the large-volume dot. At least the other-dot ejection wave element is located between the first and second large-dot ejection wave elements. The drive pulse generating means generates a drive pulse containing the first and second large-dot ejection wave elements.

According to an eighth aspect of the present invention, in the ink jet recording head apparatus of the ink jet recording apparatus of the first to fourth aspects, the wave elements include a plurality of large-dot ejection wave elements for respectively ejecting a large ink drop forming a large-volume dot and an other-dot ejection wave element for ejecting an ink drop forming a dot having a size other than the large-volume dot, which is arranged between the large-dot ejection wave elements. The drive pulse generating means generates a drive pulse composed of at least one ejection wave element.

According to a ninth aspect of the present invention, in the ink jet recording head apparatus of the ink jet recording apparatus of the eighth aspect, the waveforms of the plurality of large-dot ejection wave elements are substantially the same with each other.

According to a tenth aspect of the present invention, in the ink jet recording head apparatus of the ink jet recording apparatus of the eighth and ninth aspects, two large-dot ejection wave elements are arranged in the drive signal so as to appear at a constant interval.

According to an eleventh aspect of the present invention, in the ink jet recording apparatus of the first aspect, the wave elements include a plurality of filling wave elements capable of driving the pressure generating element to fill ink into the pressure generating chamber, and an ejection wave element capable of driving the pressure generating element to eject an ink drop. The connection element interconnects the filling wave elements. The drive pulse generating means generates a drive pulse containing one selected filling wave element and an ejection wave element.

According to a twelfth aspect of the present invention, in the ink jet recording apparatus of the first to eleventh aspects, the connection element includes constant voltage portions at both ends coupled to the wave element.

According to a thirteenth aspect of the present invention, there is provided an ink jet recording apparatus comprising: a pressure generating element for expanding and contracting a pressure generating chamber in response to a drive pulse to vary an ink pressure within the pressure generating chamber in order to eject an ink drop from an nozzle orifice associated with the pressure generating chamber; drive signal generating means for generating for generating a drive signal; and drive pulse generating means for generating a drive pulse from the drive signal, the drive pulse generating means generating a first drive pulse containing an expansion wave element for expanding the pressure generating chamber and holding the expanded state of the pressure generating chamber, a first filling wave element for further expanding the pressure generating chamber expanded by the expansion wave element, and a first ejection wave element for contracting the pressure generating chamber expanded by the first filling wave element.

According to a tenth aspect of the present invention, in the ink jet recording apparatus of the fourteenth aspect, a time period for holding the expanded state of the pressure generating chamber is longer than the period of a natural period of the pressure generating chamber.

According to a fifteenth aspect of the present invention, in the ink jet recording apparatus of the ninth and tenth aspects, the drive pulse generating means generates a second drive pulse containing a contraction wave element for contracting the pressure generating chamber and holding the contracted state of the pressure generating chamber, a second filling wave element for expanding the pressure generating chamber contracted and held by the contraction wave element to fill ink therein, and a second ejection wave element for contracting the pressure generating chamber expanded by the second filling wave element to eject an ink drop.

According to a sixteenth aspect of the present invention, in the ink jet recording apparatus of the thirteen to fifteenth aspects, the expansion wave element consists of stepwise expansion wave elements for stepwise expanding the pressure generating chamber.

According to a seventeenth aspect of the present invention, in the ink jet recording apparatus of the thirteenth to sixteenth aspects, the contraction wave element consists of stepwise contraction wave elements for stepwise contracting the pressure generating chamber.

According to an eighteenth aspect of the present invention, in the ink jet recording apparatus of the thirteenth to seventeenth aspects, at least one of the drive pulses is divided into a plurality of wave elements in the drive signal. At least one other wave element for forming other drive pulse is located among the divided wave elements. The drive pulse generating means selectively composes the divided wave elements into a drive pulse.

According to a nineteenth aspect of the present invention, in the ink jet recording apparatus of the thirteenth to eighteenth aspects, the expansion wave element, which is to constitute at least one of the drive pulses, is divided into a plurality of expansion segments. At least one ejection wave element, which is to constitute at least one other drive pulse, is located among the divided expansion segments to form the drive signal.

According to a twentieth aspect of the present invention, in the ink jet recording apparatus of the thirteenth to nineteenth aspects, the contraction wave element, which is to constitute at least one of the drive pulses, is divided into a plurality of contraction segments. At least one ejection wave element, which is to constitute at least one other drive pulse, is located among the divided contraction segments to form the drive signal.

According to a twenty-first aspect of the present invention, in the ink jet recording apparatus of the eighteenth to twentieth aspects, an expansion segment constituting a part of the expansion wave element is located the front part of the drive signal. The first ejection wave element is located at the end part of the drive signal.

According to a twenty-second aspect of the present invention, in the ink jet recording apparatus of the eighteenth to twenty-first aspects, different voltage levels of the divided wave elements are mutually connected by the connection element.

According to a twenty-third aspect of the present invention, in the ink jet recording apparatus of the first to twenty-second aspects, the pressure generating element is a piezoelectric vibrator of the flexural vibration type.

According to a twenty-fourth aspect of the present invention, in the ink jet recording apparatus of the first to twenty-second aspects, the pressure generating element is a piezoelectric vibrator of the longitudinal vibration type.

According to a twenty-fifth aspect of the present invention, in the ink jet recording apparatus of the first to twelfth and twenty-second aspects, the pressure generating element includes a piezoelectric vibrator of the longitudinal vibration type. An end point of the wave element for decreasing the voltage from a medium voltage is set at a voltage level within a range of 5V from a ground potential and connected to the connection element.

According to a twenty-sixth aspect of the present invention, there is provided a method of driving an ink jet recording apparatus comprising the steps of: generating a drive signal containing divided wave elements mutually connected by at least one connection element; selecting wave elements located before and after the connection element on the time axis; composing the selected wave elements into a drive pulse; and applying the generated drive pulse to an pressure generating element to eject an ink drop.

According to a twenty-seventh aspect of the present invention, there is provided a method of driving an ink jet recording apparatus comprising the steps of: generating a drive pulse for expanding the pressure generating chamber, holding the expanded state of the pressure generating chamber for a predetermined time period, further expanding the expanded pressure generating chamber and contracting the further expanded pressure generating chamber; and applying the drive pulse to a pressure generating element to eject an ink drop.

BRIEF DESCRIPTION OF THE DRAWINGS

In the accompanying drawings:

FIG. 4 is a diagram showing a first embodiment of the present invention: FIG. 4(*a*) shows a waveform of a drive signal; FIG. 4(*b*) shows an explanatory diagram for explaining a connection element in the drive signal; and FIG. 4(*c*) shows a table showing the relationships between the gradation values and print data;

FIG. 11(*a*) is a waveform diagram showing a drive signal and drive pulses in the sixth embodiment of the present invention, and FIGS. 11(*b*) and 11(*c*) are diagrams showing connection elements;

FIG. 12(*a*) is a waveform diagram showing a drive signal and drive pulses in the seventh embodiment of the present invention, and FIGS. 12(*b*) to 12(*d*) are diagrams showing connection elements;

DETAILED DESCRIPTION OF THE PREFERRED EMBODIMENTS

Figure 1:
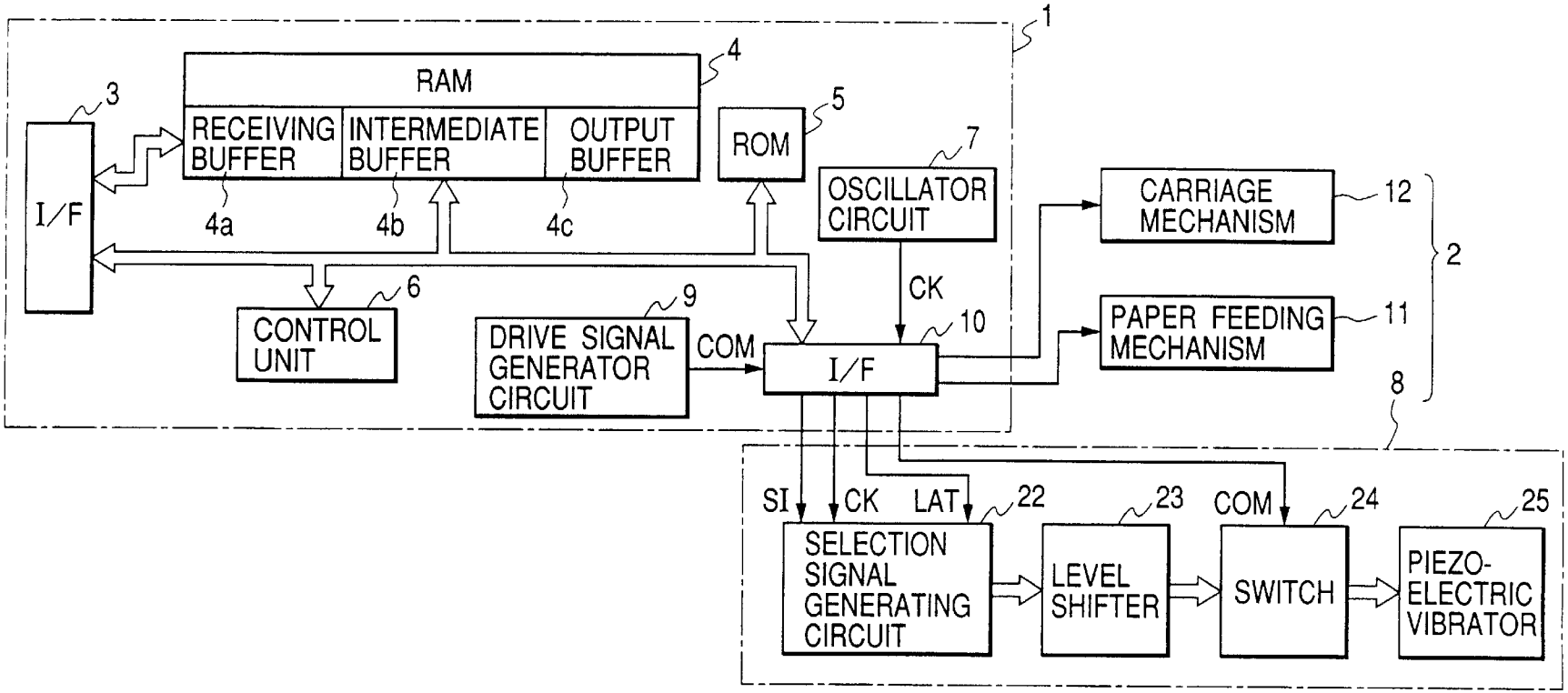
FIG. 1 is a functional block diagram showing an overall ink jet recording apparatus.

The preferred embodiments of the present invention will be described with reference to the accompanying drawings. FIG. 1 is a functional block diagram showing an ink jet recording apparatus into which the present invention is incorporated.

The ink jet recording apparatus includes a printer controller 1 and a print engine 2. The printer controller 1 includes: an interface 3 which receives print data, various instructions and others from, for example, a host computer (not shown); a RAM 4 for storing various data; a ROM 5 for storing control routines for various data processings; a control unit 6 including CPU or CPUs; an oscillator circuit 7; a drive-signal generator circuit 9 for generating drive signals to be transmitted to a recording head 8; and an interface 10 which transmits print data taking the form of dot pattern data (bit map data), drive signals and others to the print engine 2. The drive-signal generator circuit 9 is one form of drive signal generating means of the present invention.

The interface 3 receives print data consisting of at least one of character codes, graphic functions, and image data from the host computer, for example. Further, the interface sends a busy (BUSY) signal, an acknowledge (ACK) signal and others to the host computer.

The RAM 4 is used for a receiving buffer 4*a*, an intermediate buffer 4*b*, an output buffer 4*c*, a work memory (not shown) and others. The receiving buffer 4*a* temporarily stores print data which comes in through the interface 3 from the host computer. The intermediate buffer 4*b* stores intermediate code data into which the print data is converted by the control unit 6. Dot pattern data decoded from gradation data is stored into the output buffer 4*c*. This will be described in detail later.

The ROM 5 stores various control routines to be executed by the control unit 6, font data, graphic functions and others.

The control unit 6 reads out print data from the receiving buffer 4*a* and converts it into intermediate code data, and then stores the intermediate code data into the intermediate buffer 4*b*. Further, the control unit 6 reads out the intermediate code data from the intermediate buffer 4*b*, and expands it into dot pattern data while referring to font data and graphic functions that are stored in the ROM 5. The expanded dot pattern data is subjected to a necessary modifying process and the resultant is stored into the output buffer 4*c*.

When the amount of the dot pattern data reaches that corresponding to one line of the recording head 8, the dot pattern data is serially transferred through the interface 10 to the recording head 8. When the one-line dot pattern data is output from the output buffer 4*c*, the contents of the intermediate buffer 4*b* are erased, and the next conversion from the print data to intermediate code data is performed.

The print engine 2 is made up of the recording head 8, a paper feeding mechanism 11 and a carriage mechanism 12. The paper feeding mechanism 11, which includes at least a paper feed motor and paper feed rollers, feeds printing media, e.g., recording papers, to the related location in successive manner. In other words, the paper feeding mechanism 11 produces a subscanning motion in the printing operation. The carriage mechanism 12 includes a carriage on which the recording head 8 is mounted, and a pulse motor for moving the carriage with the aid of a timing belt. The carriage mechanism 12 produces a main scanning motion in the printing operation.

Figure 2:
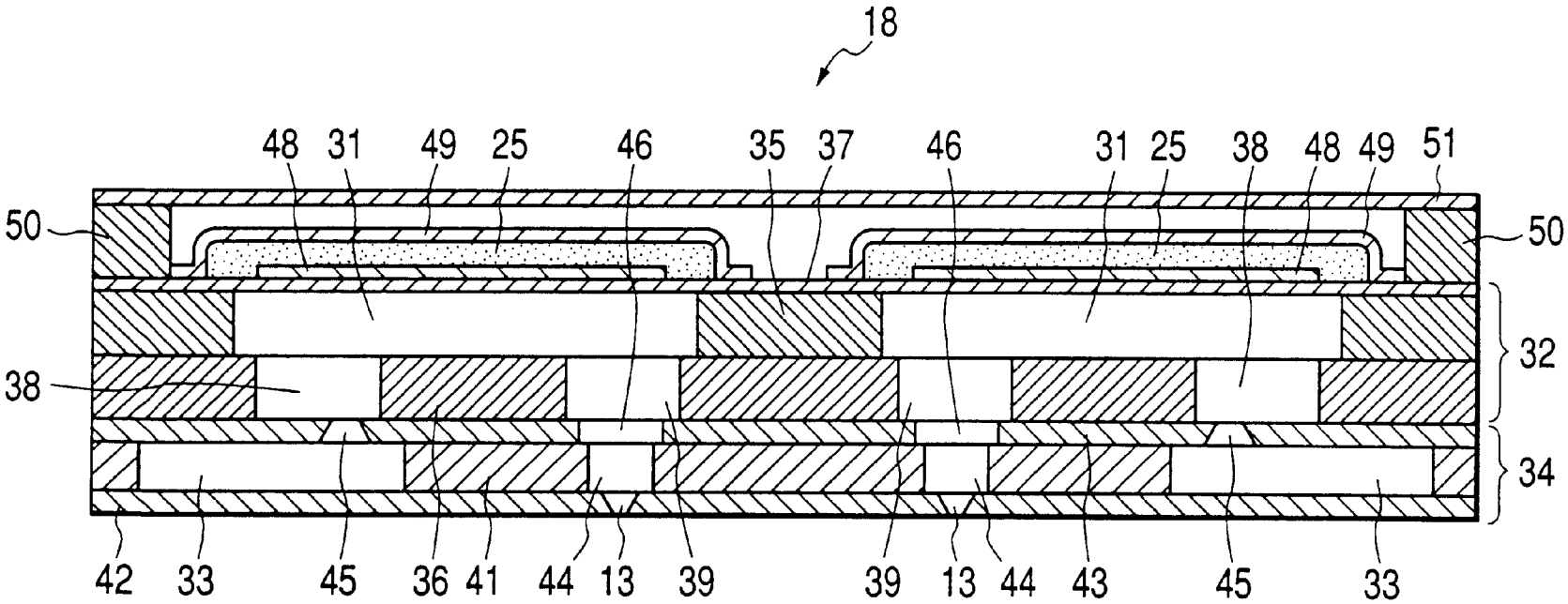
FIG. 2 is a sectional view showing a structure of a recording head.

The recording head 8 has a number (for example, 64) of nozzle orifices 13 are arrayed in the subscanning direction (see FIG. 2). Ink drops are jetted from the nozzle orifices 13.

The print data SI now taking the form of dot pattern data is serially transferred to a selection signal generating section 22 by way of the interface 10, while being synchronized with a clock signal CK derived from the oscillator circuit 7. The selection signal generating section 22 generates a selection signal based on the print data upon reception of a latch signal LAT and supplies the selection signal to a level shifter as a voltage amplifier. The selection signal is provided to select essential parts out of a drive signal COM generated by the drive-signal generator circuit.

The level shifter 23 outputs a switch signal to a switch circuit 24 in accordance with the selection signal. The drive signal is inputted to the switch circuit 24 and a piezoelectric vibrator 25 is connected to the output side of the switch circuit 24. The circuit switch 24 is made conductive by the input of the switch signal. The piezoelectric vibrator 25 may be one form of the pressure generating element in the present invention.

The print data controls the operation of the switch circuit 24. During a period that the print data transferred to the switch circuit 24 is "1" in logic state, the selection signal is outputted from the selection signal generating section 22 and the switch signal is outputted from the level shifter 23 to allow the drive signal to be input to the piezoelectric vibrator 25. The piezoelectric vibrator is mechanically deformed in accordance with the drive signal. During a period that the print data transferred to the switch circuit 24 is "0" in logic state, the switch circuit 24 prohibits the drive signal from going to the piezoelectric vibrator 25.

With a deformation of the piezoelectric vibrator 25, an ink drop is jetted from the nozzle orifice 13.

The details of the recording head 8 will be given. A structure of the recording head 8 will first be described. The recording head 8 shown in FIG. 2 contains a piezoelectric vibrator 25 of the flexural vibration type.

The recording head 8 includes: an actuator unit 32 having a plurality of pressure generating chambers 31; and a channel unit 34 having nozzle orifices 13 and ink reservoirs 33, and piezoelectric vibrator 25. The channel unit 34 is bonded to the front face of the actuator unit 32. while the piezoelectric vibrator 25 are provided on the rear face thereof.

The pressure generating chamber 31 is expanded and contracted with deformation of the piezoelectric vibrator 25 associated therewith, so that a pressure within the pressure generating chamber 31 varies. With the pressure variation within the pressure generating chamber 31, ink is jetted in the form of an ink drop through the nozzle orifice 13 associated therewith. More precisely, the interior of the pressure generating chamber 31 is pressurized by abruptly contracting the pressure generating chamber, so that ink is forcibly discharged out of the pressure generating chamber through the nozzle orifice 13.

The actuator unit 32 includes a chamber forming substrate 35 in which spaces to be used for pressure generating chambers 31 are formed, a cover member 36 to be bonded onto the front side of the chamber forming substrate 35, and a vibration plate to be bonded on the rear side of the chamber forming substrate 35 to close the spaces thereof. The cover member 36 includes first ink channel 38 and second ink channel 39. The first ink channels 38 communicate the ink reservoirs 33 with the pressure generating chambers 31, respectively. The second ink channels 39 communicate the pressure generating chambers 31 with the nozzle orifices 13, respectively.

The channel unit 34 includes an reservoir forming substrate 41 in which spaces to be used for ink reservoirs 33 are formed, a nozzle plate 42 having a number of nozzle orifices 13 which is bonded on the front side of the reservoir forming substrate 41, and a port forming plate 43 bonded on the rear side of the reservoir forming substrate 41.

The reservoir forming substrate 41 includes through holes 44 respectively communicated with the nozzle orifices 13. The port forming plate 43 includes ink supply ports 45 each communicating a ink reservoir 33 and its associated first ink channel 38, and through holes 46 each communicating a though hole 44 and its associated through hole 46.

Thus, the recording head 8 includes a plural number of ink channels formed therein, each channel ranging from a ink reservoir 33 through its associated pressure generating chamber 31 to its associated nozzle orifice 13.

Each piezoelectric vibrator 25 is disposed while being opposed to its associated pressure generating chamber 31 with respect to the vibration plate 37. Lower electrodes 48 are formed on the front side of the piezoelectric vibrator 25, shaped like a planar plate, while upper electrodes 49 are formed on the rear side of the piezoelectric vibrator 25 while covering the latter.

Connection terminals 50 are formed at both ends of the actuator unit 32. The lower ends of each connection terminal 50 is electrically connected to the upper electrode 49 of the piezoelectric vibrator 25. The upper end of the connection terminal 50 is located where is higher than the piezoelectric vibrator 25. A flexible circuit board 51 is bonded to the upper ends of the connection terminals 50. A drive signal is applied to each piezoelectric vibrator 25 by way of the connection terminal 50 and the upper electrode 49.

The pressure generating chambers 31, the piezoelectric vibrators 25 and the connection terminals 50 are each two in number in FIG. 2. Actually, pressure generating chambers, the piezoelectric vibrators and the connection terminals are provided corresponding in number to the nozzle orifices 13, and hence the number of those are large.

When a drive pulse is applied to the recording head 8, a potential difference is created between the upper electrode 49 and the lower electrode 48. The piezoelectric vibrator 25, when placed under this potential difference, contracts in the direction perpendicular to an electric field caused by the potential difference. At this time, one side of the piezoelectric vibrator 25 (coupled to the vibration plate 37) located on the lower electrode 48, is not contracted, while the other side thereof located on the upper electrode 49 is contracted. As a result, the piezoelectric vibrator 25 and the vibration plate 37 are curved toward the pressure generating chamber 31, and hence the volume of the pressure generating chamber 31 is reduced.

To eject an ink drop through the nozzle orifice 13, the pressure generating chamber 31 is abruptly contracted. At this time, an ink pressure within the pressure generating chamber 31 is increased, and the increased pressure forcibly discharge ink in the form of an ink drop through the nozzle orifice 13, from the pressure generating chamber 31. After the discharging of the ink drop, the potential difference between the upper electrode 49 and the lower electrode 48 is removed, the piezoelectric vibrator 25 and the vibration plate 37 are returned into their original state. As a result, the pressure generating chamber 31 is expanded, and ink is supplied from the ink reservoir 33 to the pressure generating chamber 31 via the ink supply port 45.

An electrical configuration of the recording head 8 will now be described.

Figure 3:
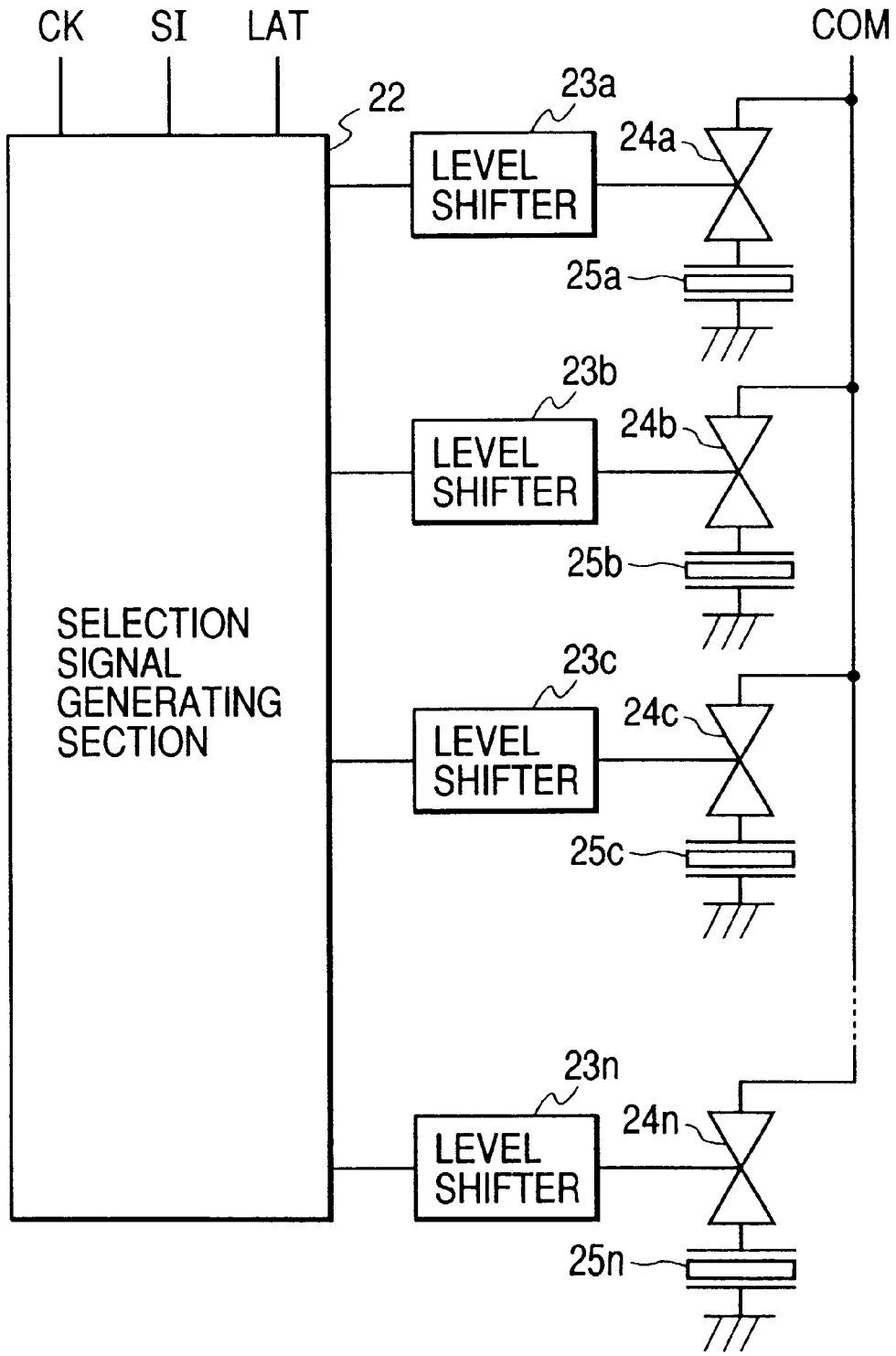
FIG. 3 is a block diagram showing an essential portion of a recording head drive circuit.

The recording head 8, as shown in FIG. 1, includes at least the selection signal generating section 22, the level shifter 23, the switch circuit 24 and the piezoelectric vibrator 25, which serve as drive pulse generating means in the present invention. As shown in FIG. 3, the level shifter 23 is constructed with level shifter elements 23*a* to 23*n*. The switch circuit 24 is constructed with switch elements 24*a* to 24*n*. The piezoelectric vibrator 25 is constructed with piezoelectric vibrator elements 25*a* to 25*n*. The selection signal generated by the selection signal generating section 22 is selectively provided to the level shifter elements 23*a* to 23*n* in accordance with the print data. The conductive states of switch elements 24*a* to 24*n* are selectively controlled by the selection signal. The drive signal COM generated by the drive-signal generator circuit 9 is commonly inputted to the respective switch circuit 24*a* to 24*n*. When the respective switch elements 24*a* to 24*n* are made conductive, the drive signal is selectively provided to the associated piezoelectric vibrator elements 25*a* to 25*n* respectively connected to the associated switch circuit 24*a* to 24*n*.

In the recording head 8 thus electrically configured, print data SI of dot pattern data is serially transferred from the output buffer 4*c* and the resultant data stream is successively loaded into the shift register 21.

The highest significant bit data (=print data D1 in FIG. 4(*a*)) of the print data for all the nozzle orifices 13 is first sent out in a serial manner. Following the serial transmission of the highest significant bit data, the second order bit data (=print data D2) is then sent out. Subsequently, the third, fourth, . . . order bit data, if present, are sent out in a serial manner.

When the print data for all the nozzle orifices 13 have been loaded into the shift register elements 21*a* to 21*n*, the control unit 6 sends a latch signal LAT to the latch circuit 22 at a proper time point. In response to the latch signal LAT, the latch circuit 22 latches the print data, which receives from the shift register 21. The print data is supplied from the latch circuit 22 to the level shifter 23 as a voltage amplifier. When the print data is "1", for example, the level shifter 23 amplifies the print data signal to have a signal (voltage) level (for example, several tens V) high enough to drive the switch circuit 24. The print data signal thus level-shifted is applied to the switch elements 24*a* to 24*n*, so that those switch elements are turned on.

At this time, a drive signal COM has been applied to the switch elements 24*a* to 24*n*, from the drive-signal generator circuit 9. The switch elements 24*a* to 24*n*, when turned on, allow the drive signal to be input to the piezoelectric vibrator elements 25*a* to 25*n*, which are coupled for reception with the switch elements 24*a* to 24*n*, respectively.

Thus, in the recording head 8, it is controlled whether the drive signal is inputted to the piezoelectric vibrator 25 based on the print data. During a period that the print data is "1", the switch circuit 24 is turned on to allow the drive signal to be input to the piezoelectric vibrator 25 in order to deform the same. During a period that the print data is "0", the switch circuit 24 is turned off to prohibit the drive signal from being inputted to the piezoelectric vibrator 25. During this period, the piezoelectric vibrator 25 holds the amount of charge at the preceding period, and hence the preceding deformation state of the vibrator is retained.

A control of the recording head 8 will be described. In the description to follow, four gradation levels, "large dot", "medium dot", "small dot" and "non-print", are used for ease of explanation. The "large dot" is a relatively large dot formed by using a large ink drop of which the ink volume is about 20 pL (picoliter). The "medium dot" is a medium-size dot formed by using an ink drop of which the ink volume is about 8 pL. The "small dot" is a relatively small dot formed by using a relatively small ink drop of which the ink volume is about 4 pL.

FIG. 4(*a*) shows a waveform diagram showing a waveform of a drive signal generated by the drive-signal generator circuit 9. The waveform is configured so as to eject three ink drops of different ink volumes, a large ink drop, a medium ink drop and a small ink drop through the same nozzle orifice 13.

The drive-signal generator circuit 9 generates the drive signal at print periods T of 7.2 kHz. The print periods T defines a printing speed of the recording apparatus. The drive pulse generator, which includes the selection signal generating section 22, the level shifter 23 and the switch circuit 24, receives the drive signal having the thus configured waveform, and processes the signal waveform to generate a small-dot drive pulse for the ejection of a small ink drop, a medium-dot drive pulse for the ejection of a medium ink drop, and a large-dot drive pulse for the ejection of a large ink drop.

How to process the drive signal and to generate drive pulses will be described.

The waveform of the drive signal (FIG. 4(*a*)) contains wave elements and connection elements. The "wave element" is an element supplied to the piezoelectric vibrator 25 to deform the same. The connection element is an element which does not deform the piezoelectric vibrator 25, and interconnects the adjacent wave elements connection ends of which have different voltage level.

The wave element may be classified into a contraction wave element, a filling wave element, an ejection wave element, and a damp wave element. The contraction wave element deforms the piezoelectric vibrator 25 to such an extent that the resultant contraction of the pressure generating chamber 31 fails to eject an ink drop. The filling wave element deforms the piezoelectric vibrator 25 such an extent as to expand the pressure generating chamber 31 and to fill ink into the same. The ejection wave element deforms the piezoelectric vibrator 25 to abruptly contract the pressure generating chamber 31 to eject an ink drop through the nozzle orifice 13. The damp wave element damps a fluctuation of the meniscus in the nozzle orifice, which last immediately after the ink drop ejection, and terminates them for a short time. The "meniscus" means a curved surface (free surface) of a column of ink in the nozzle orifice 13.

In the waveform of the drive signal shown in FIG. 4(*a*), one wave element ranges from P1 to P10', and another wave element ranges from P12' to P24. A connection element ranges from P10' to P12'. A waveform segment ranging from P1 to P2' of the wave element is a contraction wave element; a waveform segment from P2' to P5 is a first filling wave element; a waveform segment from P5 to P9 is a first ejection wave element; a waveform segment from P9 to P10' is a first damp wave element; a waveform segment from P12' to P15 is a second filling wave element; a waveform segment from P15 to P17 is a second ejection wave element; a waveform segment from P17 to P18 is a second damp wave element; a waveform segment from P18' to P21 is a third filling wave element; a waveform segment from P21 to P23 is a third ejection wave element; and a waveform segment from P23 to P24 is a third damp wave element.

A wave segment between P2' to P3 is a connection end in the first filling wave element: a wave segment between P10 to P10' is a connection end in the first damp wave element; a wave segment between P12' to P13 is a connection end in the second filling wave element; a wave segment P18 to P18' is a connection end in the second damp wave element; and a wave segment P18' to P19 is a connection end in the third filling wave element.

The drive pulse generator properly combines those wave elements, viz., the contraction wave element, the filling wave element, the ejection wave element, and the damp wave element, to form a plurality kinds of drive pulses.

The connection element connects an end point P10' of the first damp wave element and a start point P12' of the second filling wave element. In other words, the connection element couples a medium voltage VM at the end point P10' of the first damp wave element and a highest voltage VH at the start point P12' of the second filling wave element.

The wave element (P1 to P10', P12 to P24) of the drive signal is a signal element supplied to the piezoelectric vibrator 25. Therefore, it is configured in consideration with a response characteristic of the piezoelectric vibrator 25 and an ink state in the pressure generating chamber 31. Precisely, gradient and timing of voltage variation of the wave element are limited in their selection. More precisely, it is necessary to set the voltage variation gradient at a predetermined level or smaller, and the voltage variation timing at a predetermined timing suited to an ink ejection.

If the voltage variation gradient is too sharp, the vibration of the piezoelectric vibrator 25 fails to follow a voltage-vibration of the wave element, and ejection of an ink drop of a desired volume fails. In this case, even if the piezoelectric vibrator 25 can vibrate following the voltage variation, the pressure generating chamber 31 is abruptly expanded to possibly cause a cavitation within the pressure generating chamber 31. With the presence of the cavitation, the ink volume of the ink drop will be unstable. Further, the vibration plate 37 is subjected to an excessive mechanical stress, and in an extreme case, the vibration plate 37 will be broken.

The voltage variation timing follows. In an ink ejection mode, called "pull and shoot" mode, in which an ink drop is jetted or shot in a manner that the pressure generating chamber 31 is expanded and then it is contracted, the contraction of the pressure generating chamber 31 is timed depending on a state of ink flowing from the ink reservoir 33 to the pressure generating chamber 31; the pressure generating chamber 31 is contracted when a state of ink within the pressure generating chamber 31 is varied to be suitable for ink drop ejection.

More precisely, the pressure generating chamber 31 is contracted at the generation of a pressure wave. The pressure wave, which has the opposite direction (i.e., ink ejection direction) to the ink flowing direction, is generated when the pressure generating chamber 31 is expanded to set up a negative pressure therein, and ink flows into the pressure generating chamber 31. If the contraction timing of the pressure generating chamber 31 is so selected, the ink drop can be jetted in the optimum condition. If the pressure generating chamber 31 is contracted at a timing improper to the ink drop ejection, for example, a timing out of the generation of the pressure wave of the opposite direction, the size of the ink drops jetted are not uniform, resulting in print quality degradation.

In the embodiment under discussion, the different voltage levels of the different wave elements are mutually coupled by the connection element. With this, if the number of wave elements that may be contained in the drive signal is increased when comparing with the conventional one, those wave elements may be put within the print period T.

As recalled, the connection element is unable to deform the piezoelectric vibrator (pressure generating element) 25. Therefore, the voltage variation gradient may be set to be large, viz., the voltage may be varied sharply. Where the voltage variation gradient is large, the period Ts required for the connection element may be short. The fact implies that an extremely short time is required for mutually coupling the wave elements which are different in voltage levels at their connection ends, for example, the first damp wave element and the second filling wave element. In connection with the voltage-gradient portion (P11 to P12), the time period of that portion is not longer than that of the voltage-gradient portion (for example, P5 to P6, P15 to P16) of the wave element for deforming the piezoelectric vibrator 25.

As seen from the above description, one print period T limited in its length by a printing speed of the recording apparatus may contain an increased number of the wave elements of which the gradient and the timing of the voltage variation are determined in connection with the piezoelectric vibrator 25.

The fact implies that the volume of one ink drop may be varied over a broad range if the wave elements are properly configured; a selection freedom of the wave elements is increased. Therefore, a drive pulse for causing the ejection of an ink drop having an extremely small ink volume and another drive pulse for causing the ejection of an ink drop having a large ink volume can be produced by use of one drive signal.

It is noted that the start part P10' to P11 and the end part P12 to P12' of the connection end of the connection element are not varied in voltage level. Provision of the fixed voltage segments in the waveform of the drive signal accrues to the following merits. In connecting the wave elements, a switching time of the switch circuit 24 can be secured to provide an ease connection of the wave elements. No voltage difference is present between the wave elements to be connected, and hence no rush current flows into the joint portion of the wave elements. Presence of no rush current leads to no damage of circuit elements, e.g., transistors, of the switch circuit 24. A preferable time length of the fixed voltage segment is 2 $\mu$s or longer.

To generate a small-dot drive pulse (FIG. 5) from the drive signal, the drive pulse generator selects the contraction wave element (P1 to P2'), the first filling wave element (P2' to P5), the first ejection wave element (P5 to P9), and the first damp wave element (P9 to P10') from among those wave elements, and connects them time sequentially.

To generate a medium-dot drive pulse from the drive signal, the drive pulse generator selects the contraction wave element, the second filling wave element (P12' to P15), the second ejection wave element (P15 to P17), and the second damp wave element (P17 to P18'), and connects them time sequentially.

To generate a large-dot drive pulse, the drive pulse generator selects the contraction wave element, the second filling wave element, the second ejection wave element, the second damp wave element, the third filling wave element (P18' to P21), the third ejection wave element (P21 to P23), and the third damp wave element (P23 to P24), and time-sequentially connects them into a single waveform.

Print data of 5 bits is used for the selection and connection of the wave elements by the drive pulse generator. For this reason, in the embodiment, the drive signal is divided into a first wave element (P1 to P2') ranging over a period T1, a second wave element (P2' to P10') ranging over a period T2, a third wave element (P12' to P18') over a period T3, and a fourth wave element (P18' to P24) over a period T4.

To generate a small-dot drive pulse, the drive pulse generator receives print data "11000" (FIG. 4(*c*)), and turns on the switch circuit 24 during the periods T1 and T2, and selectively applies the first wave element and the second wave element to the piezoelectric vibrator 25. To generate a medium-dot drive pulse, the drive pulse generator receives print data "10010", and turns on the switch circuit 24 during the periods T1 and T3, and selectively applies the first wave element and the third wave element to the piezoelectric vibrator 25. To generate a large-dot drive pulse, the drive pulse generator receives print data "10011", and turns on the switch circuit 24 during the periods T1, T3 and T4, and selectively applies the first, third and fourth wave elements to the piezoelectric vibrator 25.

To eject no ink drop, print data "00000" is applied to the drive pulse generator, and the switch circuit 24 remains off. The relationship between the print data and the connection states of the switch circuit will be described in detail later.

Figure 5:
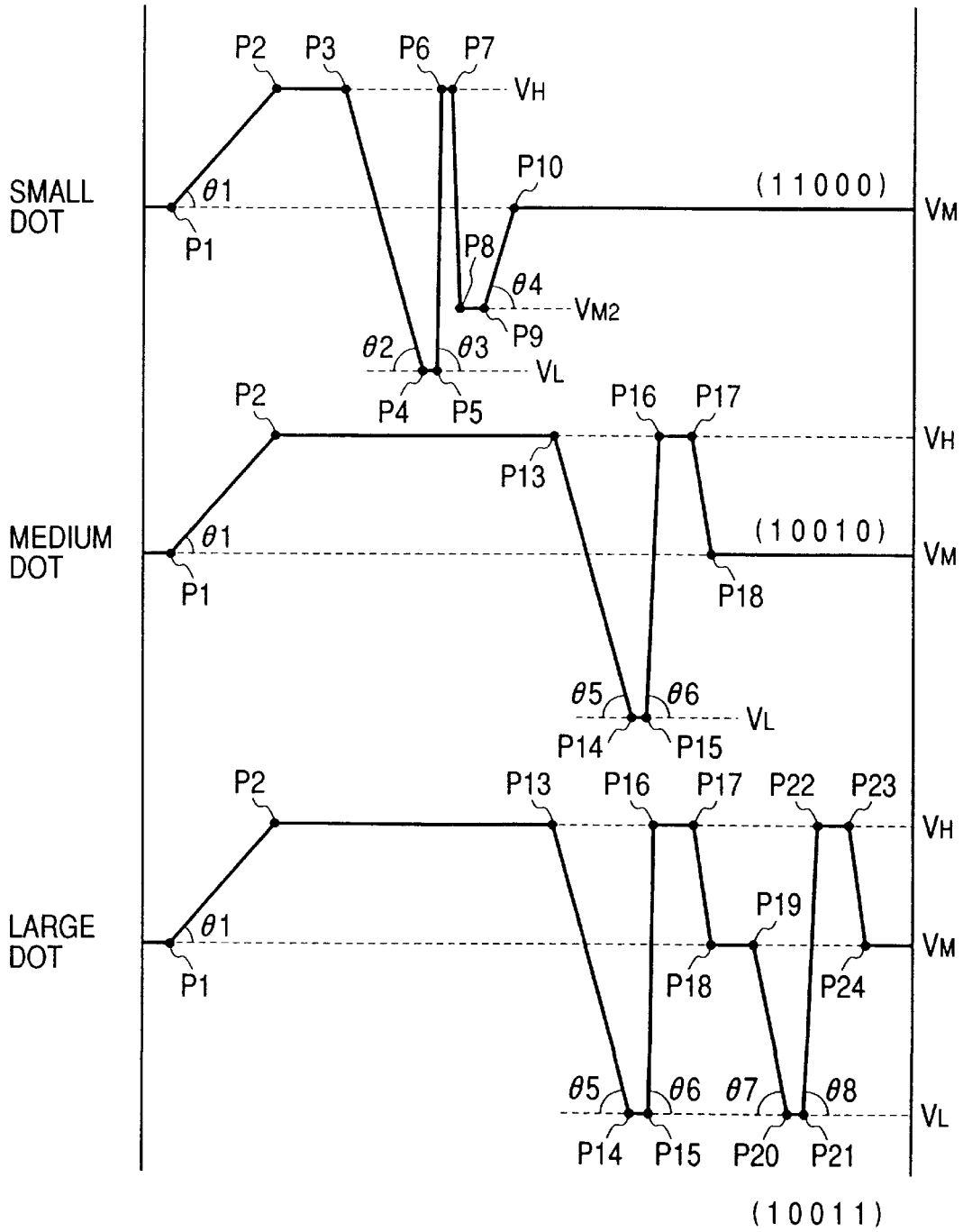
FIG. 5 is a waveform diagram showing waveforms of drive pulses in the first embodiment.

The thus composed waveform of the small-dot drive pulse is configured as shown in FIG. 5. The voltage of drive pulse is increased from the medium voltage VM to the highest voltage VH (P1 to P2) at a gradient θ1. The peak voltage VH is held for a predetermined time period (P2 to P3). The voltage oft the pulse is decreased from the highest voltage VH to a lowest voltage VL at a gradient θ2 (P3 to P4). The voltage of the pulse is increased from the lowest voltage VL to the highest voltage VH at a large gradient θ5 (P5 to P6). The voltage of the pulse is decreased to a second medium voltage VM2, which is a voltage (value) between the medium voltage VM and the lowest voltage VL (P7 to P8). The second medium voltage VM2 is held for a predetermined time period ((P8 to P9), and it is increased to the medium voltage VM at a gradient θ4 (P9 to P10).

Those gradients θ1, θ2 and θ4 of the small-dot drive pulse are selected so as not to cause the ejection of an ink drop.

When receiving the small-dot drive pulse, the piezoelectric vibrator 25 is charged and discharged to be deformed. A deformation of the piezoelectric vibrator 25 changes the volume of the pressure generating chamber 31.

The piezoelectric vibrator 25 is charged while increasing the voltage level of the pulse from the medium voltage VM. With progress of the charging, the volume of the pressure generating chamber 31 gradually decreases from the reference volume (set at the medium voltage VM). The pressure generating chamber 31 maintains its volume defined by the highest voltage VH for a predetermined time period. As the discharging of the piezoelectric vibrator 25 progresses, the volume of the pressure generating chamber 31 expands up to the maximum volume defined by the lowest voltage VL (P1 to P5).

Subsequently, the pressure generating chamber 31 is abruptly contracted from the maximum volume to the minimum volume (P5 to P6). By the abrupt change of the pressure generating chamber volume, an ink pressure within the pressure generating chamber 31 is increased, and an ink drop is jetted from the nozzle orifice 13. In this instance, the time of holding the lowest voltage VL is extremely short. Therefore, the pressure generating chamber 31 quickly expands (P7 to P8). With the quick expansion of the pressure generating chamber 31, the volume of an ink drop jetted from the nozzle orifice 13 is extremely small.

After the expansion of the pressure generating chamber 31, the pressure generating chamber 31 is contracted to return its volume to the reference one so as to damp a fluctuation of the meniscus for a short time (P8 to P10).

The composed waveform of the medium-dot pulse is configured in the following fashion. The voltage level of the medium-dot pulse is increased from the medium voltage VM to the highest voltage VH at a gradient θ1 (P1 to P2). The highest voltage VH is held for a predetermined time period (P12 to P13). Then, the pulse voltage is decreased from the highest voltage VH to the lowest voltage VL to fill ink into the pressure generating chamber 31 (P13 to P14).

After the ink charging, the pulse voltage is abruptly increased to the highest voltage VH at a gradient θ6, so that the pressure generating chamber 31 is abruptly contracted to discharge an ink drop (P15 to P16). Thereafter, the highest voltage VH is held for a predetermined time period (P16 to P17), and then the pulse voltage is decreased to the medium voltage VM (P17 to P18).

In the waveform of the medium-dot drive pulse, the pulse voltage is kept at the highest voltage VH for the period from P16 to P17, and then the pressure generating chamber 31 is expanded. Therefore, the volume of an ink drop discharged through the nozzle orifice 13 can be adjusted, by controlling the VH holding time, to be suited to the medium-dot size.

A configuration of the composed waveform of the large-dot pulse will be described. As seen from FIG. 5, in the waveform of the large-dot pulse, a specifically configured waveform is additionally connected to the tail of the waveform of the medium-dot pulse (P1 to P18). Following the trailing end (P18) of the medium-dot pulse, the pulse voltage is decreased from the medium voltage VM to the lowest voltage VL at a gradient θ7 (P19 to P20) to fill ink into the pressure generating chamber. After the ink charging, the pulse voltage is increased up to the highest voltage VH at a gradient θ8, so that the pressure generating chamber 31 is abruptly contracted to discharge an ink drop (P21 to P22). Thereafter, the highest voltage VH is held for a predetermined time period (P22 to P23), and is decreased to the medium voltage VM (P23 to P24).

When the large-dot pulse thus configured in its waveform is applied to the piezoelectric vibrator 25, a first region (P1 to P18) of the waveform of the large-dot pulse, which corresponds to the waveform of the medium-dot pulse, causes the pressure generating chamber 31 to eject a first ink drop, and a second region following the first region causes the pressure generating chamber 31 to eject a second ink drop. The first and second ink drops are merged into a large ink drop.

As described above, in the embodiment, the drive signal is formed with wave elements capable of operating the-piezoelectric vibrator 25 and connection elements incapable of operating the same. The wave elements at different voltage levels are connected by the connection element. The drive pulse generator is capable of composing the wave elements properly selected into a plurality of drive pulses of different waveforms. Therefore, an increased number of wave elements can be composed into a single drive signal within one print period.

A range within which the size of an ink drop can be varied may be broadened when comparing with the conventional one, if the wave elements are properly selected. Therefore, the recording apparatus constructed according to the present invention can eject ink drops of various volumes at high printing speed.

A procedure for supplying the print data to generate drive pulses to the piezoelectric vibrator 25 will be described.

The control unit 6 translates a gradation value of 2 bits in the intermediate code data into print data of 5 bits (D1, D2, D3, D4 and D5), and stores the resultant data into the output buffer 4*c*.

When those print data are transferred to the recording head 8, print data corresponding to the first wave element for all the nozzle orifices 13 are loaded into the selection signal generating section 22 immediately before the timing of selecting the first wave element (FIG. 4(*a*)). The print data is loaded into the registers during the period T4, for example, in the preceding print period. After the print data D1 is loaded into the registers, the control unit 6 outputs a latch signal synchronously with the first wave element generation timing.

In response to the latch signal, the selection signal generating section 22 generates a selection signal in association with the print data of "1". The selection signal is increased in voltage level by the level shifter 23, and the increased one is applied to the switch circuit 24. Then, the applicable switch circuit elements 24*a* to 24*n* are turned on to allow the first wave element of the drive signal to be input to the associated piezoelectric vibrator elements 25*a* to 25*n*.

During the first-wave-element supplying period T1, the print data corresponding to the second wave element for all the nozzle orifices 13 are loaded into the selection signal generating section 22. At the termination of the period T1, the control unit 6 outputs a latch signal. Thereby the second wave element is applied to the piezoelectric vibrator element 25 corresponding to the print data of "1". With respect to the connection element, the third wave element and the fourth wave element, similar processes are conducted.

Following completion of the processing of the fourth wave element, the printing operation of one dot for all the nozzle orifices 13 ends. Upon completion of one-dot printing, the recording apparatus performs the processing of the next dot for printing, and then repeats similar processing operations for the subsequent dots for printing.

In the first embodiment mentioned above, the second ejection wave element for the ejection of an ink drop to form a large dot is located within the period T3, and the third ejection wave element is disposed within the period T4. Both the wave elements are located close to each other on the time axis.

Therefore, there is a danger that the ink drop ejection caused by the second ejection wave element adversely affects the ink drop ejection by the third ejection wave element. If so, the volume of the ink drop jetted by the third ejection wave element will be unstable. An ink jet recording apparatus designed for solving this problem will be described. This ink jet recording apparatus constitutes a second embodiment of the present invention.

Figure 6:
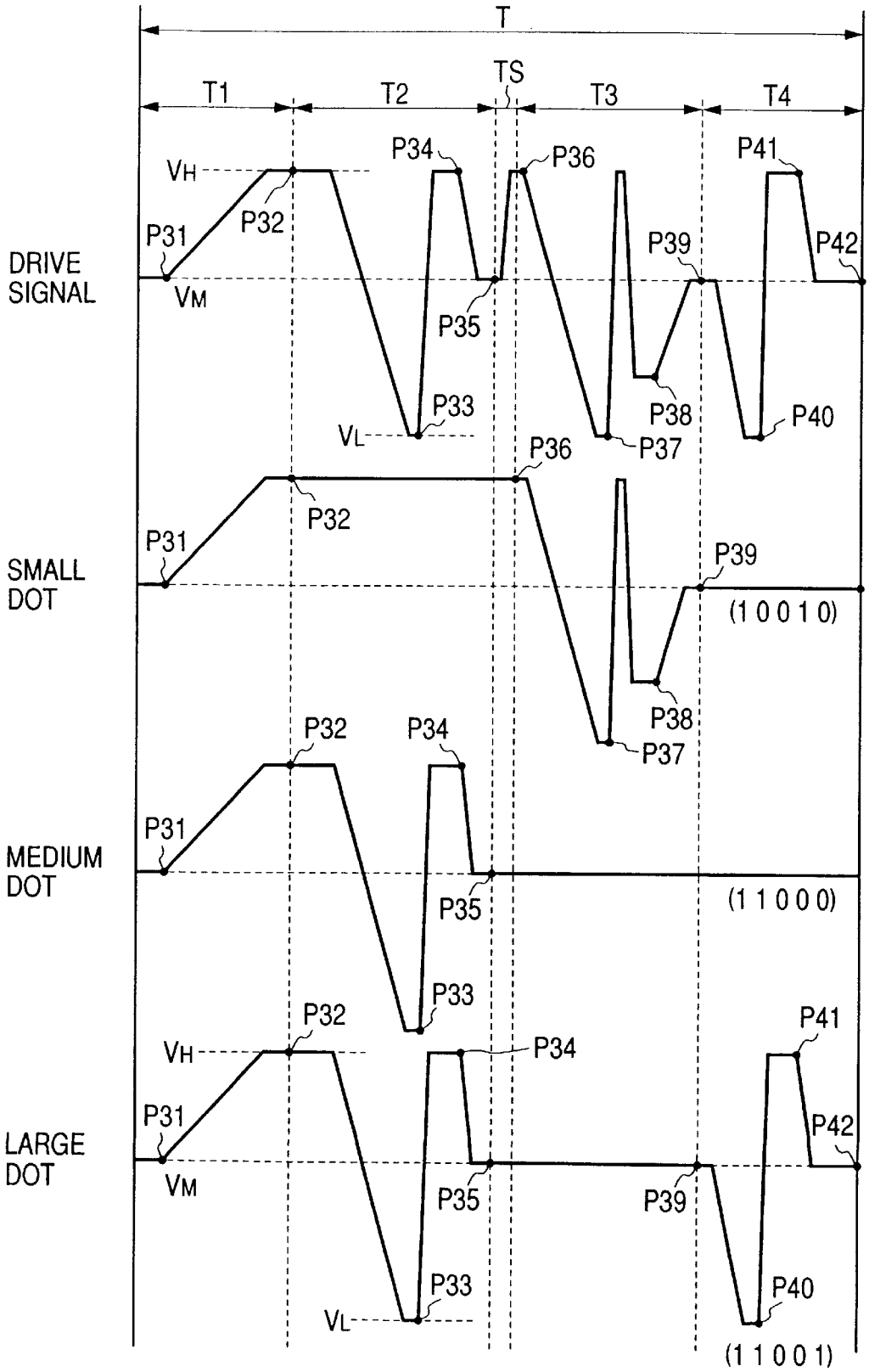
FIG. 6 is a waveform diagram showing a drive signal and drive pulses in a second embodiment of the present invention.

FIG. 6 is a waveform diagram showing one example of the waveforms of a drive signal and a drive pulses according to the second embodiment of the present invention. The waveform configurations of other signals than the drive signal are the same as those in the first embodiment, and no explanation of them will be given.

In the illustrated drive signal, a waveform segment within the period T1 (P31 to P32) is a first wave element; a waveform segment within the period T2 (P32 to P35) is a second wave element; a waveform segment within the period T3 (P36 to P39) is a third wave element; a waveform segment within the period T4 (P39 to P42) is a fourth wave element; and a waveform segment within the period TS (P35 to P36) is a connection element incapable of driving the piezoelectric vibrator 25. As seen, also in this embodiment, the connection element interconnects the wave elements of different voltage levels. With use of the connection element, an increased number of wave elements may be confined within the limited print period T.

In the embodiment, the first wave element (P31 to P32) is the same as the first wave element (P1 to P2') in the first embodiment, and contains a contraction wave element. The second wave element (P32 to P35) is the same as the third wave element (P12' to P18') in the first embodiment, and contains an ejection wave element (P33 to P34) for ejecting a medium-dot ink drop. The third wave element (P36 to P39)

is the same as the second wave element (P2' to P10') in the first embodiment, and contains an ejection wave element (P37 to P38) for ejecting a small-dot ink drop. The fourth wave element (P39 to P42) is the same as the fourth wave element (P18' to P24') in the first embodiment, and contains an ejection wave element (P40 to P41) for ejecting a large-dot ink drop.

To generate a small-dot drive pulse from the drive signal thus waveshaped, the drive pulse generator (selection signal generating section 22, level shifter 23 and switch circuit 24) selects the first wave element and the third wave element and composes them into a single waveform. Specifically, the drive pulse generator selects those wave elements in accordance with the print data of "10010". To generate a medium-dot drive pulse, the drive pulse generator selects the first wave element and the second wave element in accordance with the print data of "11000", and composes them into a single waveform. To generate a large-dot drive pulse, the drive pulse generator selects the first, second and fourth wave elements in accordance with the print data of "11001", and composes them into a single waveform.

The large-dot drive pulse thus composed contains two ejection wave elements, a first ejection wave element (P33 to P34, corresponds to the first large-dot ejection wave element), and a second ejection wave element (P40 to P41, corresponds to the second large-dot ejection wave element). The small-dot drive pulse thus composed contains an ejection wave elements (P37 to P38, corresponds to the another dot ejection wave element).

In the waveform of the drive signal, the ejection wave element of the small-dot drive pulse is located between the first and second wave elements of the large-dot drive pulse.

Where the thus waveshaped drive signal is used, a time interval from the ejection of the first ink drop to the ejection of the second ink drop, both being caused by the large-dot drive pulse, may be set to be relatively long. In other words, the first ink drop is jetted and its ink state is stabilized, and then the second ink drop is jetted. Therefore, the volume of the second ink drop is stabilized, leading to improvement of the print quality.

In the first and second embodiments, the connection element is used for connecting the damp wave element and the filling wave element. However, the connection element may be used for interconnecting the ejection wave elements. The drive signal is designed so as to realize such use of the connection element in a third embodiment of the present invention.

Figure 7:
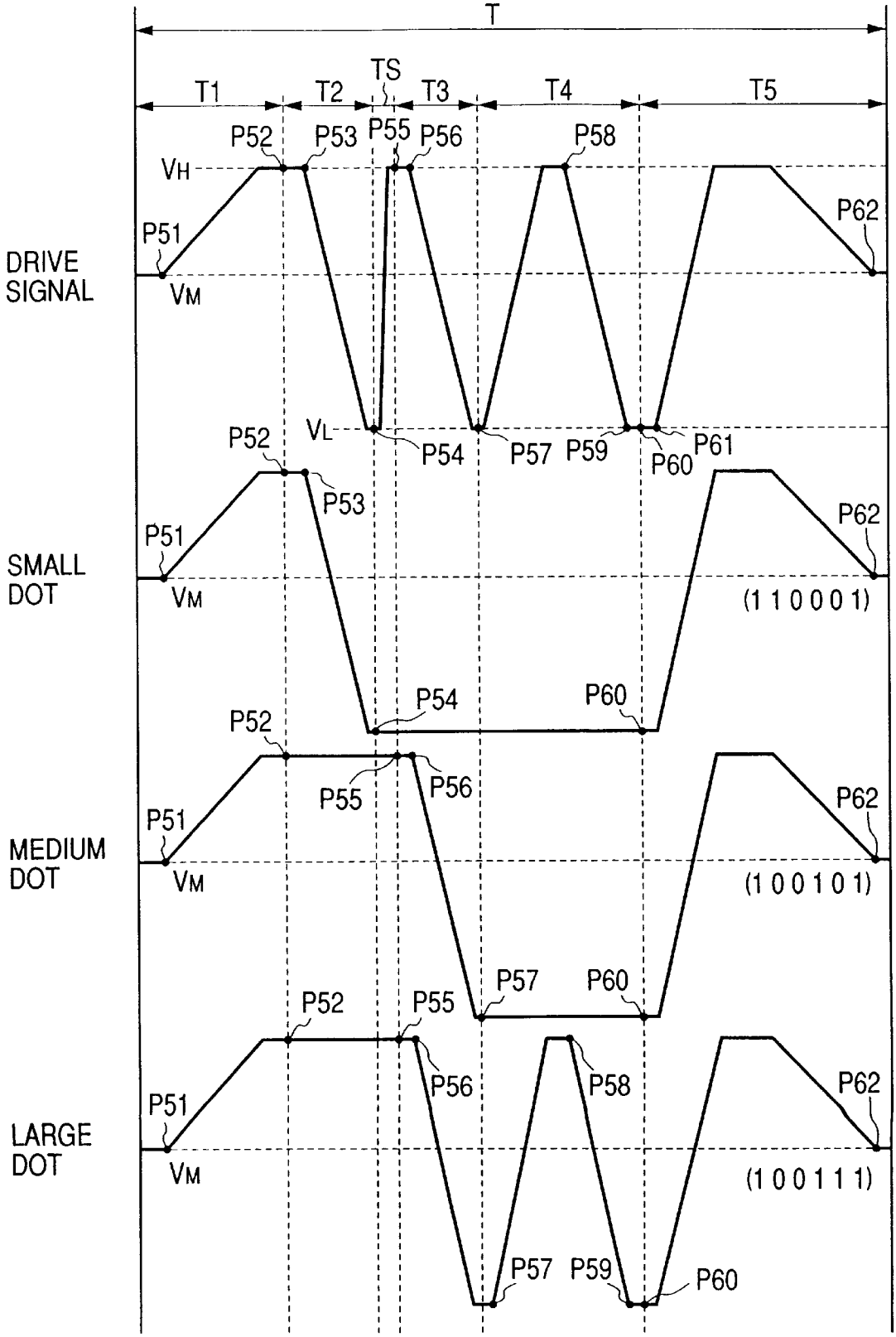
FIG. 7 is a waveform diagram showing a drive signal and drive pulses in a third embodiment of the present invention.

FIG. 7 is a waveform diagram showing one example of the waveforms of a drive signal and a drive pulses according to the third embodiment of the present invention. The waveform configurations of other signals than the drive signal are the same as those in the first embodiment, and no explanation of them will be given.

In the illustrated drive signal, a waveform segment within the period T1 (P51 to P52) is a first wave element; a waveform segment within the period T2 (P52 to P54) is a second wave element; a waveform segment within the period T3 (P55 to P57) is a third wave element; a waveform segment within the period T4 (P57 to P60) is a fourth wave element; a waveform segment within the period T5 (P60 to P62) is a fifth wave element; and a waveform segment within the period TS (P54 to P55) is a connection element incapable of driving the piezoelectric vibrator 25.

The drive signal (waveform) of the third embodiment is designed such that it abruptly expands the pressure generating chamber 31 being compressed to eject an ink drop of an extremely small volume. The highest voltage VH is applied to the piezoelectric vibrator 25 to bend toward the pressure generating chamber 31. As a result, a contraction state is set up in the pressure generating chamber 31. Then, the drive pulse voltage is abruptly decreased up to the lowest voltage VL to deform the piezoelectric vibrator 25 in the opposite direction. By the deformation, the pressure generating chamber 31 is abruptly expanded.

In this manner, a negative pressure is abruptly set up within the pressure generating chamber 31, and the meniscus in the nozzle is rapidly pulled into the pressure generating chamber 31. With the movement of the meniscus, an extremely small ink drop is separated from the center of the meniscus, is moved in the direction opposite to the inside of the pressure generating chamber 31, and is discharged through the nozzle orifice 13.

In the drive signal, a waveform segment ranging from P51 to P52 is a contraction wave element; a waveform segment ranging from P52 to P54 is a first ejection wave element; a waveform segment ranging from P55 to P57 is a second ejection wave element; a waveform segment ranging from P58 to P59 is a third ejection wave element; and a waveform segment ranging from P59 to P62 is a damp wave element.

A connection element (P54 to P55) interconnects the first and second ejection wave elements. The drive pulse generator (selection signal generating section 22, level shifter 23 and switch circuit 24) properly selects those wave elements and composes them into a single waveform. In this way, the drive pulse generator may generate a plurality kinds of drive pulses.

To generate a small-dot drive pulse from the drive signal thus waveshaped, the drive pulse generator turns on the switch circuit 24 during the periods T1, T2 and T5, and sends the first, second and fifth wave elements to the piezoelectric vibrator 25. To generate a medium-dot drive pulse from the drive signal thus waveshaped, the drive pulse generator turns on the switch circuit 24 during the periods T1, T3 and T5, and sends the first, third and fifth wave elements to the piezoelectric vibrator 25. To generate a large-dot drive pulse from the drive signal thus waveshaped, the drive pulse generator turns on the switch circuit 24 during the periods T1, T3, T4 and T5, and sends the first, third, fourth and fifth wave elements to the piezoelectric vibrator 25.

In the third embodiment, print data of 6 bits is used for the selection and connection of the wave elements by the drive pulse generator. To generate a small-dot drive pulse of "110001" is used, and the wave elements located in the periods T1, T2 and T5 are supplied to the piezoelectric vibrator 25. To generate a medium-dot drive pulse, the print data of "100101" is used, and the wave elements in the periods T1, T3 and T5 are supplied to the piezoelectric vibrator 25. To generate a large-dot drive pulse, the print data of "100111" is used, and the wave elements in the periods T1, T3, T4 and T5 are supplied to the piezoelectric vibrator 25.

The connection element (P54 to P55) interconnects the first and second ejection wave elements (P52 to P54, P55 to P57). Therefore, a time interval between the ejection wave elements may be reduced; an increased number of ejection wave elements may be contained in the drive signal within a limited print period T; and a number of different drive pulses can be produced from one drive signal.

The time interval between the ejection wave elements may be adjusted by use of the connection element. Therefore, the ink drop ejection timing may be adjusted in micro dimension steps, and hence an incorrect landing position of the ink drop on the printing medium is lessened.

In the third embodiment, the identical contraction wave element (P51 to P52) is used by both the first and second wave elements. In other words, the contraction wave element and the fist ejection wave element are composed to form a first drive pulse, and the contraction wave element and the second ejection wave element are composed to from a second drive pulse.

In the waveform of the drive signal, the size of the ink drop can be adjusted by use of a time interval between the contraction wave element and the ejection wave element. The time interval can be adjusted by use of an variation gradient of the connection element and a waveform flat segment. Therefore, the size of the ink drop can be adjusted in microscopic level. The result is further improvement of the print quality.

The technical concept of the third embodiment is also valid in such a case where the filling wave element is used in place of the contraction wave element, and a plurality of drive pulses are generated at the timings of selecting the ejection wave element and the filling wave element.

The drive signal contains a plurality of ejection wave elements capable of driving the piezoelectric vibrator 25 to eject ink drops at different time points. Specifically, the drive signal contains a first ejection wave element (P53 to P54), a second ejection wave element (P56 to P57), and a third ejection wave element (P58 to P59).

The drive pulse generator generates a plurality of drive pulses such that a small-dot ink drop is jetted earlier than a large-dot ink drop. When a small-dot drive pulse for ejecting a small ink drop is compared with a medium-dot drive pulse, the ejection wave element (P53 to P54) for the small-dot drive pulse appears before the ejection wave element (P56 to P57) for the medium-dot drive pulse appears.

The smaller the volume of the ink drop is, the earlier the ink drop is jetted. A flying velocity of an jetted ink drop somewhat depends on the size of the ink drop. The larger the ink drop is, the faster the ink drop flies. Therefore, a time from the ejection of the ink drop till it lands on a printing medium is also minutely affected by the size of the ink drop. A time taken for a large ink drop to land on the recording paper is short, while a time taken for a small ink drop to land on the recording paper is long.

Therefore, the landing time difference resulting from ink drop size difference may be reduced by ejecting the small ink drop earlier than the large ink drop. Further improvement of the print quality results.

While in the third embodiment, the connection element interconnects the ejection wave elements, the filling wave elements may mutually be connected by the connection element. A drive signal wave-shaped so as to realize this will be discussed in a fourth embodiment of the present invention.

Figure 8:
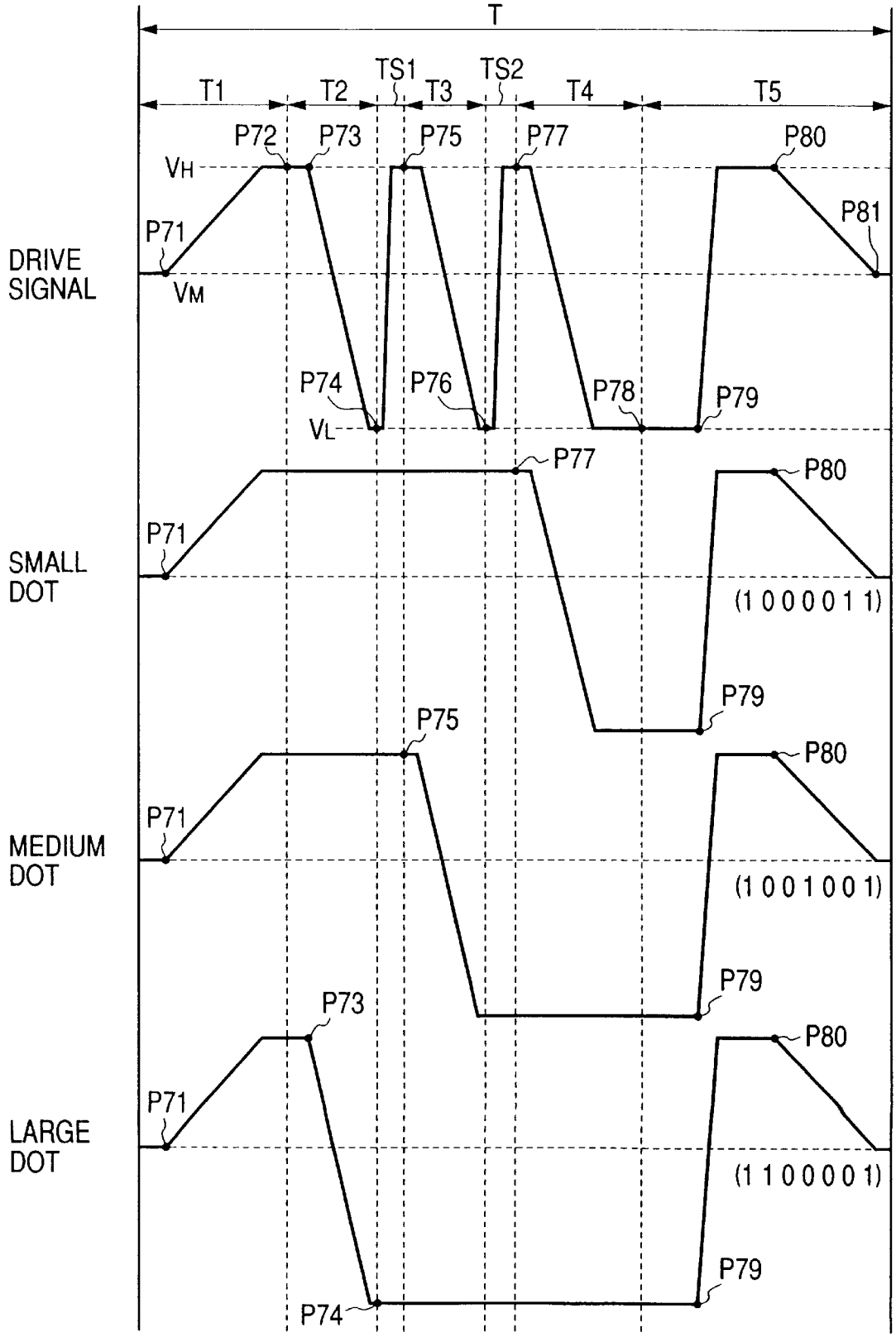
FIG. 8 is a waveform diagram showing a drive signal and drive pulses in a fourth embodiment of the present invention.

FIG. 8 is a waveform diagram showing one example of the waveforms of a drive signal and a drive pulses according to the fourth embodiment of the present invention. The waveform configurations of other signals than the drive signal are the same as those in the first embodiment, and no explanation of them will be given.

In the drive signal shown in FIG. 8, a waveform segment within the period T1 (P71 to P72) is a first wave element; a waveform segment within the period T2 (P72 to P74) is a second wave element; a waveform segment within the period T3 (P75 to P76) is a third wave element; a waveform segment within the period T4 (P77 to P78) is a fourth wave element; a waveform segment within the period T5 (P78 to P81) is a fifth wave element; a waveform segment within a period TS1 (P74 to P75) is a first connection element; and a waveform segment within a period TS2 (P76 to P77) is a s second connection element .

The drive signal of the fourth embodiment contains a plurality of filling wave elements and one ejection wave element. The volume of an ink drop to be jetted may be changed by properly combining those wave elements. In other words, a plurality of filling wave elements for causing different ink charge states are provided, and those wave elements are properly combined to adjust the volume of the ink drop.

In the waveform of the drive signal, a waveform segment from P71 to P72 is a contraction wave element; a waveform segment from P72 to P74 is a first filling wave element; a waveform segment from P75 to P76 is a second filling wave element; a waveform segment from P77 to P78 is a third filling wave element; a waveform segment from P79 to P80 is an ejection wave element; and a waveform segment from P80 to P81 is a damp wave element.

The first connection element (P74 to P75) connects the first and second filling wave elements, and the second connection element (P76 to P77) connects the second and third filling wave elements.

Since a plurality of filling wave elements are connected together by use of the connection element, intervals therebetween can be shortened. Therefore, an increased number of filling wave elements may be packed into the drive signal within one print period.

The drive pulse generator (selection signal generating section 22, level shifter 23 and switch circuit 24) properly selects those wave elements and composes them into a single waveform. In this way, the drive pulse generator may generate a plurality kinds of drive pulses.

To generate a small-dot drive pulse from the drive signal thus waveshaped, the drive pulse generator turns on the switch circuit 24 during the periods T1, T4 and T5; selects the first, fourth and fifth wave elements; composes them into a small-dot drive pulse containing the contraction wave element and the third filling wave element, both being time sequentially coupled; and transfers the drive pulse to the piezoelectric vibrator 25.

To generate a medium-dot drive pulse, the drive pulse generator turns on the switch circuit 24 during the periods T1, T3 and T5; selects the first, third and fifth wave elements; composes them into a medium-dot drive pulse containing the contraction wave element and the second filling wave element, both being time sequentially coupled; and transfers the drive pulse to the piezoelectric vibrator 25.

To generate a large-dot drive pulse, the drive pulse generator turns on the switch circuit 24 during the periods T1, T2 and T5; selects the first, second and fifth wave elements; composes them into a large-dot drive pulse containing the contraction wave element and the first filling wave element, both being time sequentially coupled; and transfers the drive pulse to the piezoelectric vibrator 25.

Also in the fourth embodiment, print data of 7 bits is used for the selection and connection of the wave elements by the drive pulse generator. To generate a small-dot drive pulse of "1000011" is used, and the wave elements in the periods T1, T4 and T5 are supplied to the piezoelectric vibrator 25. To generate a medium-dot drive pulse, the print data of "1001001" is used, and the wave elements in the periods T1, T3 and T5 are supplied to the piezoelectric vibrator 25. To generate a large-dot drive pulse, the print data of "1100001" is used, and the wave elements in the periods T1, T2 and T5 are supplied to the piezoelectric vibrator 25.

In the fourth embodiment, the identical ejection wave elements are used for ejecting an ink drop. Therefore, the size of the ink drop may be determined by use of one filling wave element selected from among the first to third filling wave elements (P72 to P74, P75 to P76, P77 to P78). This contributes to simplification of the control.

Ink drops of different volumes are jetted by use of the identical ejection wave elements. This also contributes to simplification of the control.

Therefore, an ink-volume variable range may be broadened while securing high printing speed.

A fifth embodiment of the present invention will be described. In this embodiment, it is configured that the pressure generating chamber 31 of the reference volume is expanded; the expanded pressure generating chamber is held for a predetermined time period; the expanded pressure generating chamber is further expanded; and the further expanded pressure generating chamber is contracted to eject an ink drop.

Figure 9:
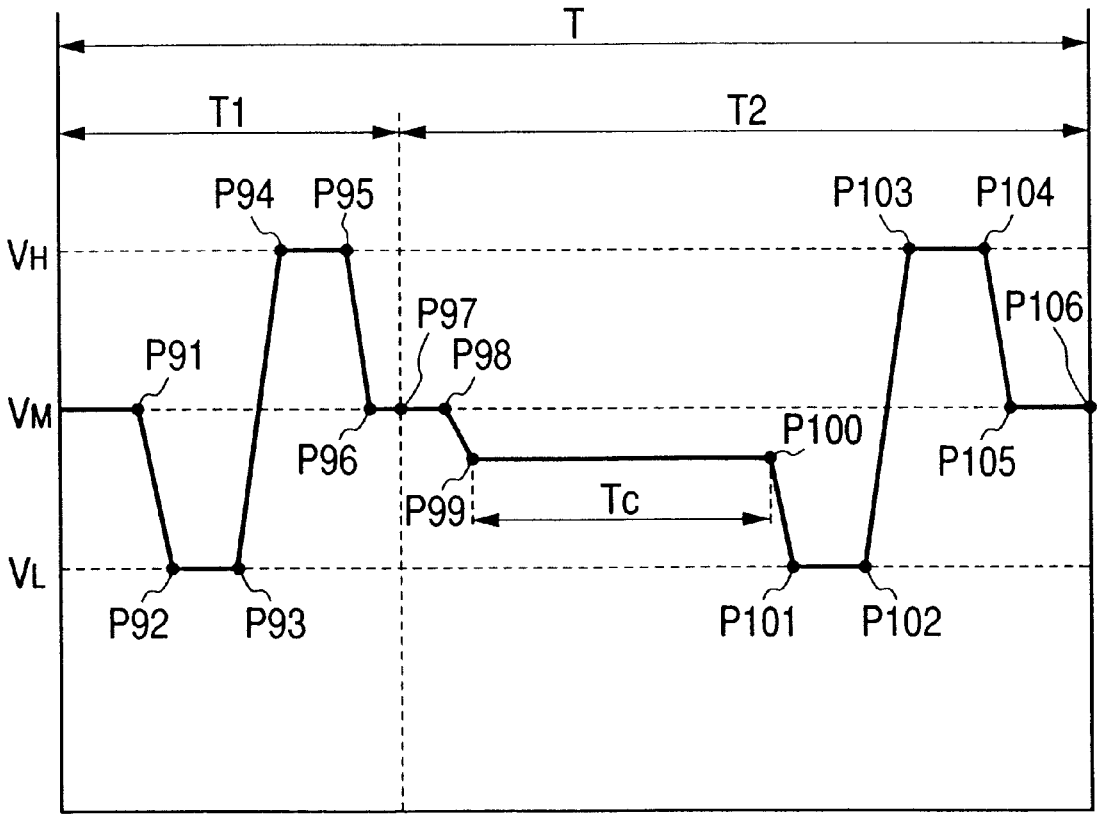
FIG. 9 is a waveform diagram showing a drive signal in a fifth embodiment of the present invention.

A waveform of the drive signal shown in FIG. 9 is capable of ejecting ink drops of different volumes, a large ink drop and a medium ink drop through the same nozzle orifice 13.

The waveform configurations of other signals than the drive signal are the same as those in the first embodiment, and no explanation of them will be given.

In the waveform of the drive signal, a waveform segment located in the period T1 (P91 to P97) is a first wave element, and a waveform segment located in the period T2 (P97 to P106) is a second wave element.

The first wave element contains a filling wave element (P91 to P93, corresponds to the second filling wave element) capable of deforming the piezoelectric vibrator 25 so as to fill ink into the pressure generating chamber 31, an ejection wave element (P93 to P95, corresponds to the second ejection wave element) capable of deforming the piezoelectric vibrator 25 so as to eject an ink drop through the nozzle orifice 13, and a damp wave element (P95 to P96) for damping a fluctuation of the meniscus immediately after the ejection of the ink drop.

The start point (P91) and the end point (P97) of the first wave element are set at the medium voltage VM. The start point (P97) and the end point (P106) of the second wave element are also set at the medium voltage VM. Since the start and end points of a plurality of wave elements are set at the medium voltage VM, those wave elements may be coupled smoothly.

The second wave element contains an expansion wave element (P98 to P100) which slightly expands the pressure generating chamber 31 of the reference volume set at the medium voltage VM, charges a slight amount of ink into the pressure generating chamber, and maintains this state of the pressure generating chamber, a filling wave element (P100 to P102, corresponds to the first filling wave element) for charging ink into the pressure generating chamber 31, an ejection wave element (P102 to P104, corresponds to the first ejection wave element) capable of ejecting an ink drop through the nozzle orifice 13, and a damp wave element for damping a fluctuation of the meniscus immediately after the ink drop ejection.

A hold time for holding the expanded pressure generating chamber 31, viz., a supply time Tc of an expansion hold wave element (P99 to P100), is provided in the expansion wave element of the second wave element. It is preferable that the hold time is long such an extent that a fluctuation of the meniscus, caused when the piezoelectric vibrator 25 is deformed so as to expand the pressure generating chamber 31, is settled down to be in an ordinary state.

The hold time is preferably longer than the period of a natural frequency of the pressure generating chamber 31, more preferably at least two times the natural frequency period. Here, the natural frequency period of the pressure generating chamber 31 is the period (approximately 8 to 10 μsec.) of a natural frequency of a meniscus proper to each type of recording head 8, determined by the capacity and dimensions of the pressure generating chamber 31.

Figure 10:
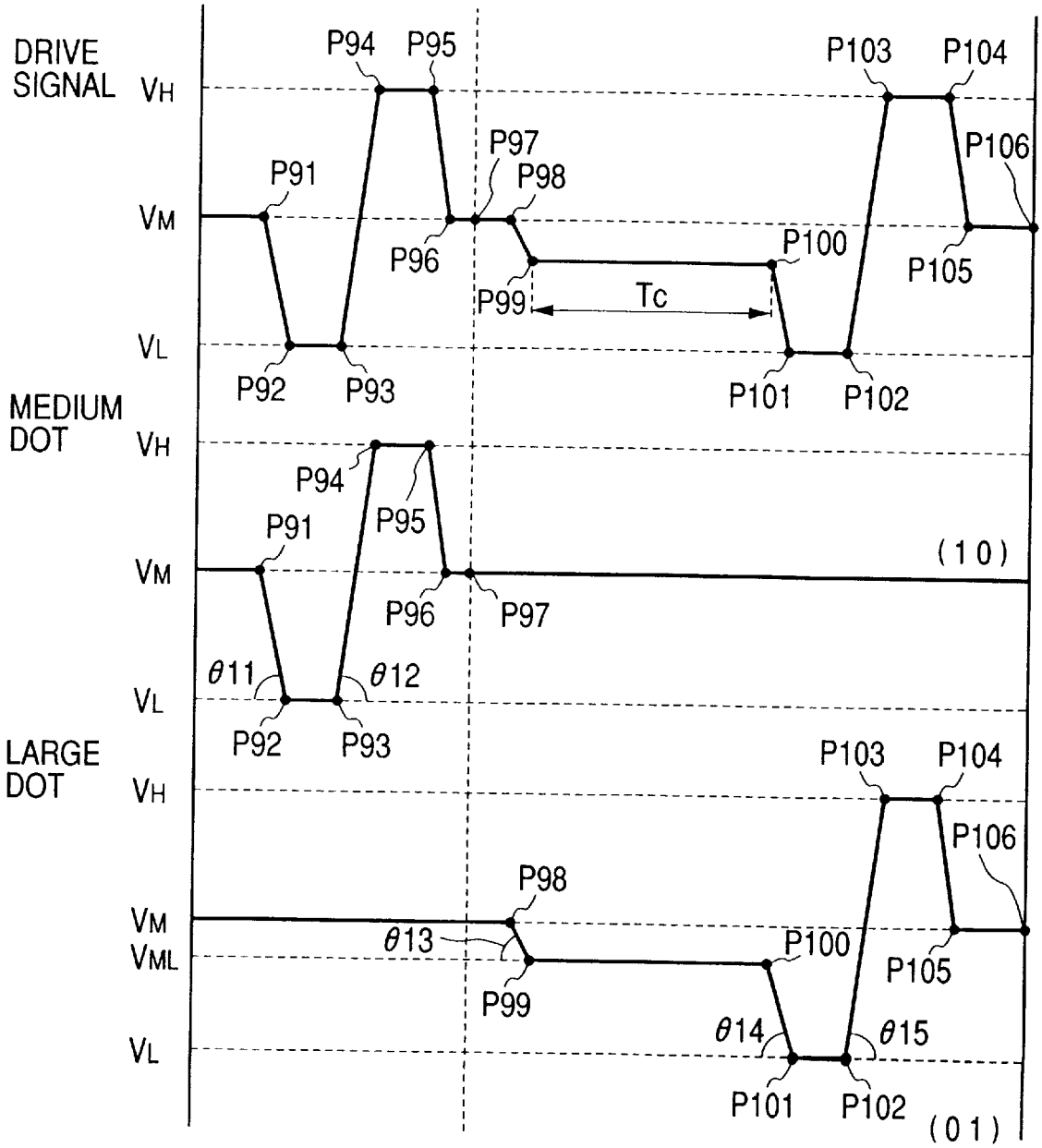
FIG. 10 is a waveform diagram showing a drive signal and drive pulses in the fifth embodiment of the present invention.

The drive pulse generator (selection signal generating section 22, level shifter 23 and switch circuit 24) properly generates one drive pulse from the drive signal. To process the drive signal to form a medium-dot drive pulse for ejecting a medium ink drop (corresponds to a second drive pulse of the present invention), as shown in FIG. 10, the drive pulse generator selects the first wave element (P91 to P97). To generate a large-dot drive pulse for ejecting a large ink drop (corresponds to a first drive pulse in the present invention), the drive pulse generator selects the-second wave element (P98 to P106).

In the fifth embodiment, 2-bit print data is used for selecting the wave element. For this reason, a waveform of the drive signal is divided into two sections, a first wave element (P91 to P97) located in a first period T1 and a second wave element (P97 to P106) located in a second period T2. To generate a medium-dot drive pulse, the print data of "10" turns on the switch circuit 24 during the period T1, which in turn allows the first wave element to be input to the piezoelectric vibrator 25. To generate a large-dot drive pulse, the print data of "01" turns on the switch circuit 24 during the period T2, which in turn allows the first wave element to be input to the piezoelectric vibrator 25. In a non-print mode where no dot is formed, the print data of "00" turns off the switch circuit 24.

When the medium-dot drive pulse thus generated is supplied to the piezoelectric vibrator 25, an ink drop is jetted in the following way.

As shown in FIG. 10, at a time point P91 set at the medium voltage VM, the piezoelectric vibrator 25 is slightly bent toward the pressure generating chamber 31, and in this state the pressure generating chamber 31 is slightly contracted. This state is an initial state, and the volume of the pressure generating chamber 31 in this state is the reference volume.

The voltage of the drive signal is decreased from the medium voltage VM to the lowest voltage VL at a gradient θ11 (P91 to P92), and the lowest voltage VL is held for a predetermined time period (P92 to P93). At this time, the piezoelectric vibrator 25 deforms with the decrease of the voltage; the pressure generating chamber 31 expands to increase its volume larger than the reference volume; and ink is charged into the pressure generating chamber 31.

Then, the lowest voltage VL is abruptly increased up to the highest voltage VH at a gradient θ12 (P93 to P94). At this time, the piezoelectric vibrator 25 is abruptly deformed, while the pressure generating chamber 31 abruptly contracts to reduce the volume thereof. The contraction of the pressure generating chamber 31 increases an ink pressure within the pressure generating chamber to eject an ink drop through the nozzle orifice 13.

The highest voltage VH is held for a predetermined time period (P94 to P95); then abruptly decreased to the medium voltage VM to expand the pressure generating chamber 31 till the chamber has the reference volume, to thereby damp the fluctuation of the meniscus for a short time (P95 to P96). Since the pressure generating chamber 31 is expanded after the lasting of the highest voltage VH, ink is moved out of the nozzle orifice 13 to some extent and then is pulled to the pressure generating chamber 31. The volume of the ink drop jetted from the nozzle orifice 13 may be adjusted by use of a lasting time period (P94 to P95) of the highest voltage VH. Therefore, an ink drop having the volume suitable for the medium dot can be jetted.

When a large-dot drive pulse is applied to the piezoelectric vibrator 25, an ink drop is jetted in the following way.

The voltage of the large-dot drive pulse is decreased from the medium voltage VM to a second medium voltage VML at a gradient θ13 (P98 to P99). The second medium voltage VML is at a mid level between the medium voltage VM and the lowest voltage VL. The second medium voltage VML is held for a predetermined time period (P99 to P100). With deformation of the piezoelectric vibrator 25, the pressure generating chamber 31 is slightly expanded to increase its volume somewhat larger than the reference volume. A slight amount of ink is charged into the pressure generating chamber 31. This state of the pressure generating chamber 31 is held for a sufficient long time Tc at the second medium voltage VML. Therefore, the fluctuation of the meniscus caused when the pressure generating chamber 31 is expanded is settled down satisfactorily.

The voltage of the drive signal is decreased from the second medium voltage VML to the lowest voltage VL at a gradient θ14 (P100 to P101). The lowest voltage VL is held for a predetermined time period (P101 to P102). At this time, the expanded pressure generating chamber 31 is further expanded, and ink is charged into the pressure generating chamber 31. Then, the drive signal voltage is abruptly increased from the lowest voltage VL to the highest voltage VH at a gradient θ15 (P102 to P103). The highest voltage VH is held for a predetermined time period (P103 to P104). At the termination of the predetermined time period, the drive signal voltage is abruptly decreased from the highest voltage VH to the medium voltage VM, and the pressure generating chamber 31 resumes its reference volume (P104 to P105). With the abrupt decrease of the voltage, the fluctuating meniscus settles down for a short time. At this time, an abrupt deformation of the piezoelectric vibrator 25 causes the pressure generating chamber 31 to rapidly contract to reduce its volume and an ink drop is jetted from the nozzle orifice 13.

The waveform of the large-dot drive pulse is configured such that the pulse voltage is decreased from the medium voltage VM to the second medium voltage VML, and the voltage VML is held for a predetermined time period (P98 to P100), and the pressure generating chamber 31 is further expanded to fill ink into the pressure generating chamber 31 (P100 to P102). The thus configured waveform lessens a pressure variation within the pressure generating chamber 31, and a retraction of the meniscus to the pressure generating chamber 31.

An amplitude of a pressure variation within the pressure generating chamber 31, caused when a large ink drop is jetted, is reduced, thereby to suppress an excessively increase of the flying velocity of the ink drop. The result is to eliminate an incorrect landing position of the ink drop on the printing medium, which arises from the ink volume difference of the ink drops.

A flying velocity of the ink drop can be adjusted by use of a degree of an expansion of the pressure generating chamber 31 and a holding time of holding an expanded state of the pressure generating chamber 31. Therefore, the flying velocity of the ink drop can be adjusted to be suited to the volume of the flying ink drop. This feature also eliminates the flying velocity difference of the ink drop caused by the ink volume difference. A further exact landing of the ink drop on the recording paper is secured.

Additionally, the fifth embodiment does not require any complicated operation to merge a plurality of fine ink drops, and can form one large dot on the printing medium by use of one ink drop, and broaden a dot-diameter variable range.

A sixth embodiment of the present invention will be described. In this embodiment, one drive pulse is divided into a plurality of wave elements, and another drive pulse is located therebetween form a drive signal.

Figure 11A:
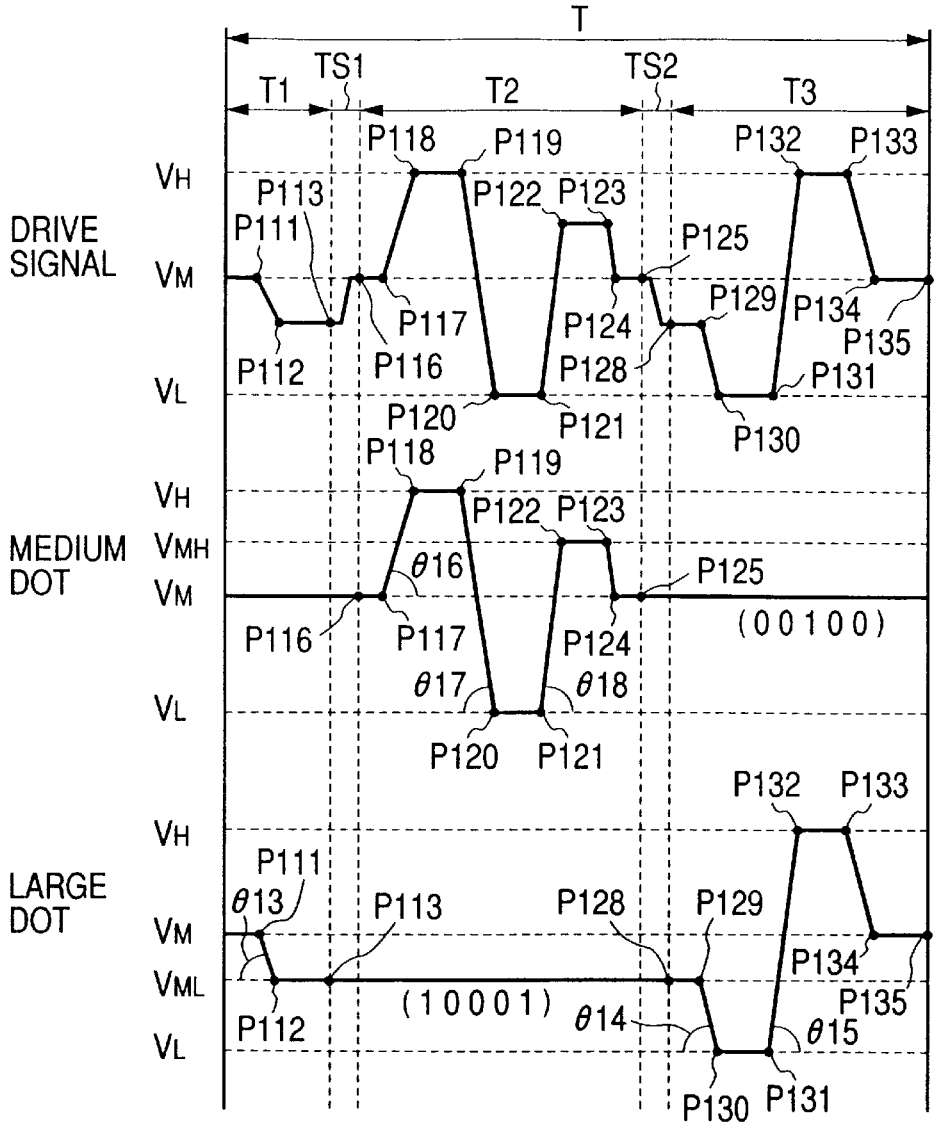
FIG. 11 shows a sixth embodiment of the present invention.
Figure 11B:
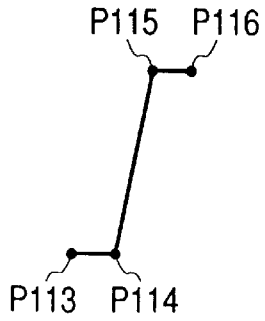
Figure 11C:
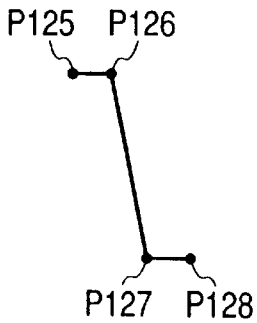
Figure 12A:
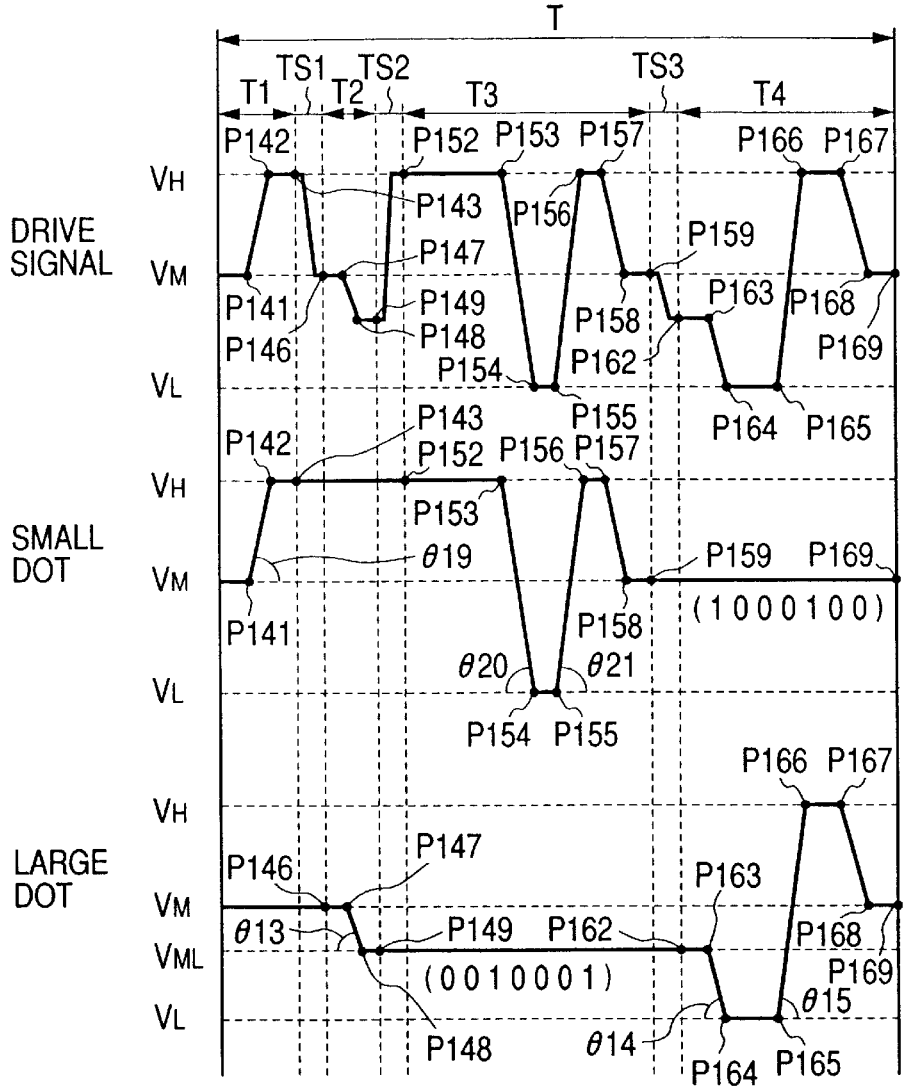
FIG. 12 shows a sixth embodiment of the present invention.
Figure 12B:
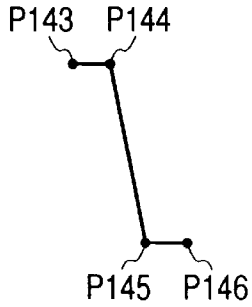
Figure 12C:
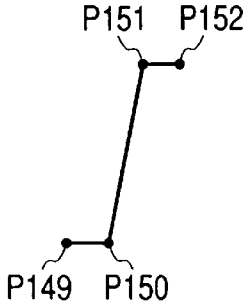
Figure 12D:
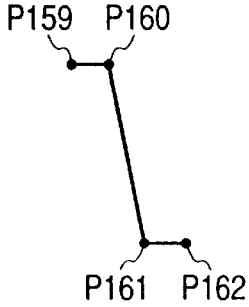

A waveform of a drive signal shown in FIG. 11 is also configured so as to eject a large ink drop and a small ink drop through the same nozzle orifice 13. The waveform configurations of other signals than the drive signal are the same as those in the first embodiment, and no explanation of them will be given.

The drive signal contains a large-dot drive pulse for ejecting a large ink drop and a medium-dot drive pulse for ejecting a medium ink drop. The large-dot drive pulse corresponds to the first drive pulse, and the medium-dot drive pulse corresponds to the second drive pulse.

A wave element of the large-dot drive pulse is divided into two wave elements, which are located in the periods T1 and T3. A wave element of the medium-dot drive pulse is located in the period T2. In other words, a first wave element located in the period T1 (P111 to P113) and a second wave element in the period T3 (P128 to P135) forming a large-dot drive pulse. A second wave element (P116 to P125) forming the medium-dot drive pulse is disposed in the period T2, which is located between the periods T1 and T3.

A first connection element (P113 to P116) (FIG. 11(*b*)) occupies a period TS1, which is located between the periods T1 and T2. The connection element connects the end point (P113) of the first wave element and the start point (P116) of the second wave element, those points being at different voltage levels. A second connection element (P125 to P128) (FIG. 11(*c*)) occupies a period TS2, which is located between the periods T2 and T3. The connection element connects the end point (P125) of the second wave element and the start point (P128) of the third wave element, those points being at different voltage levels.

The drive pulse generator (selection signal generating section 22, level shifter 23 and switch circuit 24) receives the print data of "10001" and selects the wave elements in the periods T1 and T3 of the drive signal, and composes them into a large-dot drive pulse. The drive pulse generator receives the print data of "00100" and selects the second wave element in the period T2 of the drive signal, and generates a medium-dot drive pulse.

The large-dot drive pulse contains an expansion wave element (P111 to P113, P128 to P129), a filling wave element (P129 to P131, corresponds to the first filling wave element), an ejection wave element (P131 to P133, corresponds to the first ejection wave element), and a damp wave element (P133 to P134). In the expansion wave element, the medium voltage VM descends to the second medium voltage VML, so that the pressure generating chamber 31 is somewhat expanded to charge some amount of ink into the pressure generating chamber 31, and this state of the pressure generating chamber is held for a predetermined time period. The filling wave element further expands the expanded pressure generating chamber 31 to fill ink to the pressure generating chamber. The ejection wave element is provided for ejecting an ink drop through the nozzle orifice 13. The damp wave element is for damping a fluctuation of the meniscus immediately after the ejection.

The medium-dot drive pulse contains a contraction wave element (P117 to P119), a filling wave element (P119 to P121, corresponds to the second filling wave element), an ejection wave element (P121 to P123, corresponds to a second ejection wave element), and a damp wave element (P123 to P124). In the contraction wave element, the medium voltage VM ascends to the highest voltage VH to contract the pressure generating chamber 31, and the contracted state of the pressure generating chamber is held for a predetermined time period. The filling wave element is for expanding the contracted pressure generating chamber 31 to fill ink into the pressure generating chamber. The ejection wave element is for contracting the expanded wave element to eject an ink drop through the nozzle orifice 13. With use of the damp wave element, the fluctuation of the meniscus occurring immediately after the ink ejection settles down.

When the medium-dot drive pulse thus configured is input to the piezoelectric vibrator 25, an ink drop is jetted in the following way. The voltage of the medium-dot drive pulse is increased from the medium voltage VM to the highest voltage VH at such a gradient θ16 as not to eject an ink drop (P117 to P118). The highest voltage VH is held for a predetermined time period (P118 to P119). At this time, the pressure generating chamber 31 of the reference volume contracts to reduce its volume, to thereby secure an expansion margin for the next expansion of the pressure generating chamber 31. With the time of holding the highest voltage VH, the meniscus is pushed out of the nozzle orifice 13. At instant that the pushed meniscus recoils, the pressure generating chamber 31 may be expanded. As a result, the meniscus may be pulled into the pressure generating chamber 31, and contraction of the pressure generating chamber 31 may start in a state that the meniscus is put in the pressure generating chamber 31.

Then, the voltage of the medium-dot drive pulse is decreased from the highest voltage VH to the lower peak voltage VL at a gradient θ17 (P119 to P120). The lowest voltage VL is held for a predetermined time period (P120 to P121) to fill ink to the pressure generating chamber 31. At this time, the pressure generating chamber 31 is contracted to abruptly reduce its volume, and an ink drop is jetted from the nozzle orifice 13. As described above, the contraction of the pressure generating chamber 31 starts in a state that the meniscus is pulled to and put in the pressure generating chamber 31, and an ink drop is jetted in a state that the signal voltage is abruptly increased from VL to a voltage VMH, which is somewhat lower than the highest voltage VH, at a gradient θ18 (P121 to P122). Therefore, the volume of an ink drop to be jetted is suitable for formation of the medium dot.

After a predetermined time period elapses in a state that the voltage VMH is applied to the piezoelectric vibrator (P122 to P123), the signal voltage is decreased from the voltage VMH to the medium voltage VM to damp the fluctuation of the meniscus; the pressure generating chamber 31 is expanded to resume the reference volume (P123 to P124).

An operation to eject a large ink drop by applying a large-dot drive pulse to the piezoelectric vibrator 25 is similar to that in the fifth embodiment already stated. No further description of this will be given.

In the embodiment, the waveform of the drive signal is configured such that the expansion wave element of the wave element forming a large-dot drive pulse is divided into two wave elements, a first expansion wave element (P11 to P113) and a second expansion wave element (P128 to P129), and a wave element forming the medium-dot drive pulse is located between the first and second expansion wave elements (corresponds to the partial expansion wave element). Therefore, a holding time (P121 to P129) in the expansion wave element may be set to be long. Further, the drive signal may be constructed to be short. Therefore, a plurality of drive pulses may be packed into within the limited print period.

Additionally, the ejection wave element (P121 to P122) of the medium-dot drive pulse and the ejection wave element (P131 to P133) of the large-dot drive pulse may be disposed close to each other on the time axis. The fact implies that an incorrect landing position of the ink drop on the printing medium is lessened, and that a high print quality is secured.

A seventh embodiment of the present invention will be described. A waveform of a drive signal configured in the seventh embodiment is such that a plurality of drive pulses are divided into a plurality of wave elements, and a wave element of another drive pulse is interposed between the wave elements of one dive pulse.

A drive signal shown in FIG. 12(*a*) is capable of ejecting a large ink drop and a small ink drop through the same nozzle orifice 13. The waveform configurations of other signals than the drive signal are the same as those in the first embodiment, and no explanation of them will be given.

In the drive signal, a wave element forming a small-dot drive pulse (corresponds to the second drive pulse) is divided into two wave elements located in the periods T1 and T3. A wave element forming a large-dot drive pulse (corresponds to the first drive pulse) is divided into two wave elements located in the periods T2 and T4. A first wave element (P141 to P143) in the period T1 and a third wave element (P152 to P159) in the period T3 form a small-dot drive pulse. A second wave element (P46 to P49) in the period T2 between the periods T1 and T3 and a fourth wave element (P162 to P169) in the period T4 form a large-dot drive pulse.

A first connection element (P143 to P146) (FIG. 12(*b*)) is located in a period TS1 between the periods T1 and T2. The first connection element connects the end point (P143) of the first wave element and the start point (P146) of the second wave element. A second connection element (P49 too P152, FIG. 12(*c*)) is located in a period TS2 between the periods T2 and T3, and a third connection element (P159 to P162, FIG. 12(*d*)) is located in a period TS3 between the periods T3 and T4.

The drive pulse generator (selection signal generating section 22, level shifter 23 and switch circuit 24) receives the print data of "1000100" and selects the wave elements in the periods T1 and T3 of the drive signal, and composes them into a small-dot drive pulse. The drive pulse generator receives the print data of "0010001" and selects the wave element s in the periods T2 and T4 of the drive signal, and generates a large-dot drive pulse.

When the small-dot drive pulse is applied to the piezoelectric vibrator 25, an ink drop is jetted in the following way.

The voltage of the drive pulse is increased from the medium voltage VM to the highest voltage VH at such a gradient θ19 so as not to eject an ink drop (P141 to P142). The highest voltage VH is held for a predetermined time period (P142 to P143, P152 to P153). At this time, the pressure generating chamber 31 contracts to have a volume smaller than the reference volume, and secures an expansion margin for the next expansion of the pressure generating chamber 31.

With the time of holding the highest voltage VH, the meniscus is pushed out of the edge of the nozzle orifice 13. At instant that the pushed meniscus recoils, the pressure generating chamber 31 may be expanded. As a result, the meniscus may be pulled into the pressure generating chamber 31, and contraction of the pressure generating chamber 31 may start in a state that the meniscus is put in the pressure generating chamber 31.

The signal voltage is decreased from the highest voltage VH to the lowest voltage VL at a gradient θ20 (P153 to P154). The lowest voltage VL is held for a predetermined time period (P154 to P155) to fill ink to the pressure generating chamber 31. Then, the signal voltage is increased from the lowest voltage VL to the highest voltage VH at a gradient θ21 (P155 to P156). At this time, the volume of the pressure generating chamber 31 is rapidly reduced, while an ink pressure within the pressure generating chamber 31 is increased. The result is to eject an ink drop through the nozzle orifice 13.

In this case, an ink drop is jetted in a manner that the signal voltage is increased to the highest voltage VH in a state that the meniscus is deeply pulled into the pressure generating chamber. Therefore, a small ink drop jetted has an ink volume suited to the small dot.

A state that the highest voltage VH is applied to the piezoelectric vibrator 25 is held for a predetermined time period (P156 to P157), and the signal voltage is decreased from the highest voltage VH to the medium voltage VM so as to damp the fluctuation of the meniscus for a short time; the pressure generating chamber 31 resumes the reference volume (P157 to P158).

An operation to eject a large ink drop by applying a large-dot drive pulse to the piezoelectric vibrator 25 is similar to that in the fifth embodiment already stated. No further description of this will be given.

The drive signal contains the wave elements forming the large- and small-dot ejection waveforms. Therefore, the drive signal per se may be constructed to be short, and an increased number of drive pulse waves may be confined within the limited print period. The waveform configurations of other signals than the drive signal are the same as those in the sixth embodiment, and no explanation of them will be given.

Description will be given about an eighth embodiment of the present invention in which a drive signal is capable of generating small-, medium- and large-dot drive pulses, and a degree of contraction of the pressure generating chamber 31 by the small-dot drive pulse is different from that of the pressure generating chamber 31 by the medium-dot drive pulse.

Figure 13:
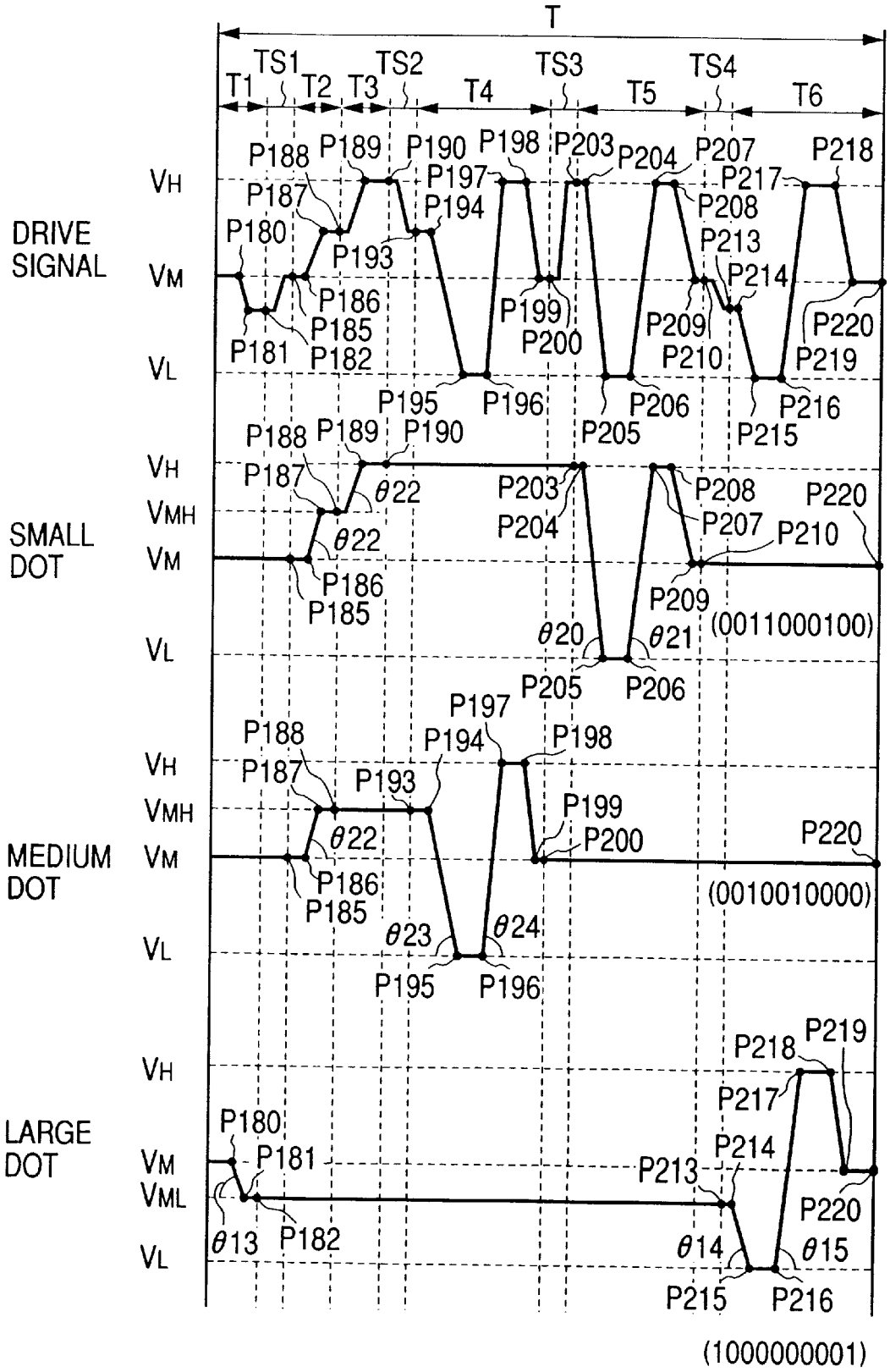
FIG. 13 is a waveform diagram showing a drive signal and drive pulses in an eighth embodiment of the present invention.
Figure 14A:
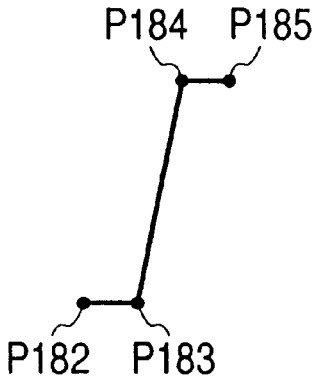
FIGS. 14(*a*) to 14(*d*) are connection elements in the eighth embodiment of the present invention.
Figure 14B:
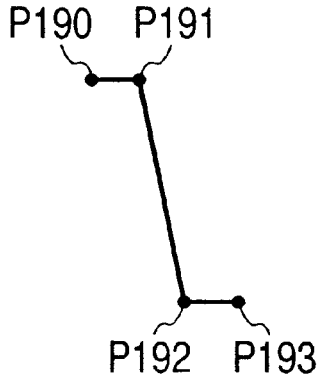
Figure 14C:
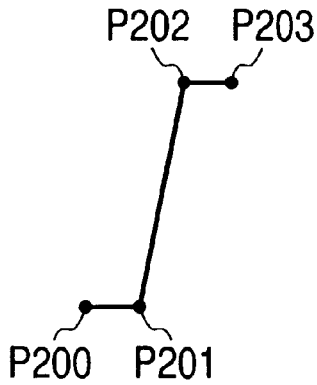
Figure 14D:
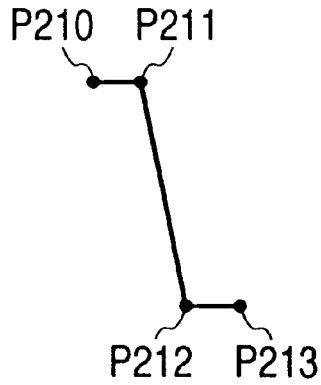

As shown in FIG. 13, in the waveform of the drive signal, a wave element forming a large-dot drive pulse (corresponds to the first drive pulse) is divided into two wave elements located in the periods T1 (P180 to P182) and T6 (P213 to P220). A wave element forming a medium-dot drive pulse (corresponds to the second drive pulse) is divided into two wave elements located in the periods T2 (P185 to P188) and T4 (P193 to P200). A wave element forming a small-dot drive pulse (corresponds to the third drive pulse) is divided into three wave elements located in the periods T2 (P185 to P188), T3 (P188 to P190), and T5 (P203 to P210).

A first connection element (P182 to P185, FIG. 14(*a*)) is located in a period TS1, located between the periods T1 and T2, and connects the end point (P182) of the first wave element and the start point (P185) of the second wave element, both points being at different voltage levels. A second connection element (P190 to P193, FIG. 14(*b*)) is located in a period TS2, located between the periods T3 and T4; a third connection element (P200 to P203), FIG. 14(*c*)) is located in a period TS3, located between the periods T4 and T5; and a fourth connection element (P210 to P213, FIG. 14(*d*)) is located in a period TS4, located between the periods T3 and T4.

The drive pulse generator (selection signal generating section 22, level shifter 23 and switch circuit 24) receives the print data of "0011000100" and selects the second, third and fifth wave elements in the periods T1, T3 and T5 of the drive signal, and composes them into a small-dot drive pulse. The drive pulse generator receives the print data of "0010010000" and selects the second and fourth wave elements in the periods T2 and T4 of the drive signal, and composes them into a medium-dot drive pulse. The drive pulse generator receives the print data of "1000000001" and selects the first and sixth wave elements in the periods T1 and T6 of the drive signal, and composes them into a large-dot drive pulse.

The large-dot drive pulse, as the first wave element in the fifth embodiment, includes expansion wave elements (P180 to P182, P213 to P214), a filling wave element (P214 to P216), an ejection wave element (P216 to P218), and a damp wave element (P218 to P219). The expansion wave element expands the pressure generating chamber 31 so as to charge some amount of ink into the pressure generating chamber 31 by decreasing the signal voltage from the medium voltage VM to the second medium voltage VML, and holds this expanded state of the pressure generating chamber for a predetermined time period (P180 to P182, P213 to P214). The filling wave element further expands the pressure generating chamber 31 already expanded by the expansion wave element to fill ink to the pressure generating chamber 31. The ejection wave element ejects an ink drop through the nozzle orifice 13. The damp wave element damps a fluctuation of the meniscus occurring immediately after the ejection.

The small-dot drive pulse includes a first contraction wave element (P185 to P188), a second contraction wave element (P188 to P190, P203 to P204), a filling wave element (P204 to P206), an ejection wave element (P206 to P208), and a damp wave element (P208 to P209). The first contraction wave element slightly contracts the pressure generating chamber 31 by increasing the signal voltage from the medium voltage VM to a third medium voltage VMH, which is between the medium voltage VM and the highest voltage VH. The second contraction wave element further contracts the contracted pressure generating chamber 31 and holds this contracted state of the pressure generating chamber. The filling wave element expands the contracted pressure generating chamber 31 to fill ink to the pressure generating chamber. The ejection wave element contracts the expanded pressure generating chamber 31 to eject an ink drop through the nozzle orifice 13. The damp wave element damps a fluctuation of the meniscus occurring immediately after the ejection.

The medium-dot drive pulse includes a first contraction wave element (P185 to P188, P193 to P194), a filling wave element (P194 to P196), an ejection wave element (P196 to P198), and a damp wave element (P198 to P199). The first contraction wave element slightly contracts the pressure gradient θ22 so as not to eject an ink drop (P186 to P187). The third medium voltage VMH is held for a predetermined time period (P187 to P188, P193 to P194). At this time, the pressure generating chamber 31 contracts to have a volume smaller than the reference volume, and secures an expansion margin for the next expansion of the pressure generating chamber 31. The signal voltage is decreased from the third medium voltage VMH to the lowest voltage VL (P194 to P195) at a gradient θ23. The lowest voltage VL is held for a predetermined time period (P195 to P196) to fill ink to the pressure generating chamber 31. Then, the signal voltage is abruptly increased from the lowest voltage VL to the highest voltage VH at a gradient θ24 (P196 to P197). At this time, the volume of the pressure generating chamber 31 is reduced to eject an ink drop through the nozzle orifice 13. The highest voltage VH is held for a predetermined time period (P197 to P198). With the time of holding the highest voltage VH, the pressure generating chamber 31 is expanded so as to damp the fluctuation of the meniscus for a short time, and the pressure generating chamber 31 resumes the reference volume (P198 to P199).

The eighth embodiment can eject a large ink drop of a relatively large volume by applying the large-dot drive pulse to the piezoelectric vibrator 25, as in the fifth embodiment.

In the drive signal of the embodiment, the contraction wave element for contracting the pressure generating chamber 31 contains a stepwise filling wave element consisting of the first contraction wave element (P186 to P188) and the second contraction wave element (P188 to P190). With use of the thus shaped filling wave element, a plurality way of stepwise voltage variation are realized by selectively connecting those two contraction wave elements, not generating chamber 31 by increasing the signal voltage from the medium voltage VM to a third medium voltage VMH, and holds this contracted state of the pressure generating chamber. The filling wave element expands the contracted pressure generating chamber 31 to fill ink to the pressure generating chamber. The ejection wave element contracts the expanded pressure generating chamber 31 to eject an ink drop through the nozzle orifice 13. The damp wave element damps a fluctuation of the meniscus occurring immediately after the ejection.

The second wave element (P185 to P188) in the period T2 is used by both the first contraction wave element of the medium-dot drive pulse and the first contraction wave element of the small-dot drive pulse.

In the drive signal, the contraction wave element for contracting the pressure generating chamber 31 contains a stepwise filling wave element consisting of two filling wave elements, the first contraction wave element in the period T2 and the second contraction wave element in the period T3.

The eighth embodiment ejects an ink drop of the small volume by applying the small-dot drive pulse to the piezoelectric vibrator 25, as in the seventh embodiment. In this embodiment, the stepwise filling wave element consisting of the first and second contraction wave elements (P185 to P188, P188 to P190) is applied to the piezoelectric vibrator 25 when the pressure generating chamber 31 is contracted.

When the medium-dot drive pulse is applied to the piezoelectric vibrator 25, an ink drop is jetted in the following way. The voltage of the drive pulse is increased from the medium voltage VM to the third medium voltage VMH (between the medium voltage VM and the highest voltage VH) at such a using greater numbers of separate contraction wave elements. Furthermore, the length of drive signal per se can be shortened.

The wave element of the large-dot drive pulse is time-axially divided into two wave elements, a first wave element and a sixth wave element, which are located in the periods T1 and T6. The expansion wave element is also divided into two expansion wave elements, first and second expansion wave elements. The first expansion wave element is contained in the first wave element occupying the front part of the drive signal. The second expansion wave element is contained in the sixth wave element.

Since another wave element is thus placed in the holding time of the expansion wave element, the holding time of the expansion wave element may be selected to be sufficiently long, and reduction of the entire drive signal results.

The first expansion wave element contains an expansion segment (P180 to P181). The expansion segment partly forming the expansion wave element occupies the front part of the drive signal. An ejection wave element (P216 to P218) of the large-dot drive pulse is located at the end part of the drive signal. With this, another wave elements may be located in the holding time of the expansion wave element. The holding time of the expansion wave element may be selected to be sufficiently long, and reduction of the entire drive signal results.

As described above, the contraction wave element for contracting the pressure generating chamber 31 contains a stepped contraction wave element (stepwise filling wave element) consisting of the first contraction wave element and the second contraction wave element. The same thing is correspondingly applied to the wave element for expanding the pressure generating chamber 31: the expansion wave element consists of a stepped wave element (stepwise expansion wave element) consisting of first and second expansion wave elements.

In the waveform of the drive signal of the embodiment, the wave element forming the medium-dot drive pulse is divided into the first contraction wave element (P185 to P188) and the second contraction wave element (P193 to P194). The wave element forming a small-dot drive pulse is disposed between the first and second contraction wave elements. An increased number of wave elements may be confined within the limited print period.

Each drive pulse generated by the drive pulse generator is designed such that the ejection wave element (P196 to P198) of the medium-dot drive pulse is located before the ejection wave element (P205 to P208) of the small-dot drive pulse on the time axis, and that the ejection wave element (P216 to P218) of the large-dot drive pulse is located after the ejection wave element of the small-dot drive pulse on the time axis.

In a bi-directional print mode, the ink drops are jetted in the order of a medium ink drop, a small ink drop and a large ink drop during the print period T in the forward print direction, and those are jetted in the order of a large ink drop, a small ink drop and a medium ink drop in the backward print direction. When the forward print direction is compared with the backward print direction, only difference between them is that the landing position of the large ink drop is replaced with that of the medium ink drop. This indicates that the print quality is improved.

A ninth embodiment of the present invention will be described in which large-, medium- and small-dot drive pulses, and an in-print fine vibration pulse are generated from a drive signal.

Figure 15:
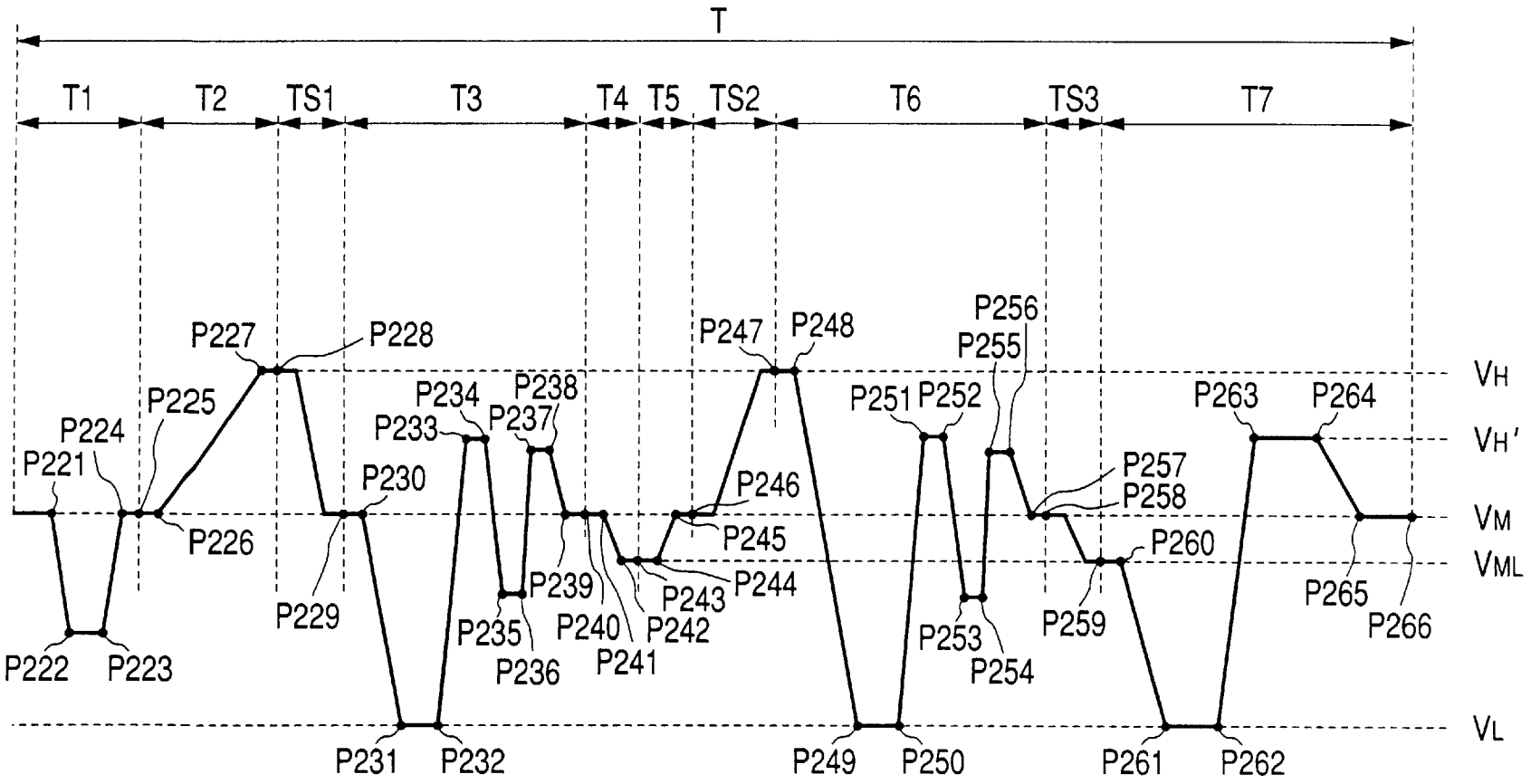
FIG. 15 is a waveform diagram showing a drive signal in a ninth embodiment of the present invention.

As shown in FIG. 15, a wave element forming an in-print fine vibration pulse is divided into three wave elements, and those wave elements are located in the periods T1 (P221 to P225), T4 (P240 to P243), and T5 (P243 to P246). A wave element forming a small-dot drive pulse (corresponds to the second drive pulse) is divided into two wave elements, and those wave elements are located in the period T2 (P225 to P228) and the period T6 (P247 to P258). A wave element forming a medium-dot drive pulse (corresponds to the second drive pulse) is located in the period T3 (P230 to P240). A wave element forming a large-dot drive pulse (corresponds to the first drive pulse) is divided into two wave elements, and those wave elements are located in the period T4 (P240 to P243) and the period T7 (P260 to P266). The wave element in the period T4 is used by both the large-dot drive pulse and the in-print fine vibration pulse.

A first connection element (P228 to P229) is located in a period TS1 between the periods T2 and T3. A second connection element (P246 to P247) located in a period TS2 between the periods T5 and T6, and a third connection element (P258 to P259) is located in a period TS3 between the periods T3 and T4.

The drive pulse generator (selection signal generating section 22, level shifter 23 and switch circuit 24) receives the print data of "0000100001" and selects the fourth and seventh wave elements in the periods T4 and T7 of the drive signal, and composes them into a large-dot drive pulse. The drive pulse generator receives the print data of "0001000000" and selects the third wave element in the periods T3 of the drive signal, and composes them into a medium-dot drive pulse. The drive pulse generator receives the print data of "0100000100" and selects the second and sixth wave elements in the periods T2 and T6 of the drive signal, and composes them into a medium-dot drive pulse. The drive pulse generator receives the print data of "1000110000" and selects the first, fourth and fifth wave elements in the periods T1, T4 and T5 of the drive signal, and composes them into an in-print fine vibration pulse.

Figure 16:
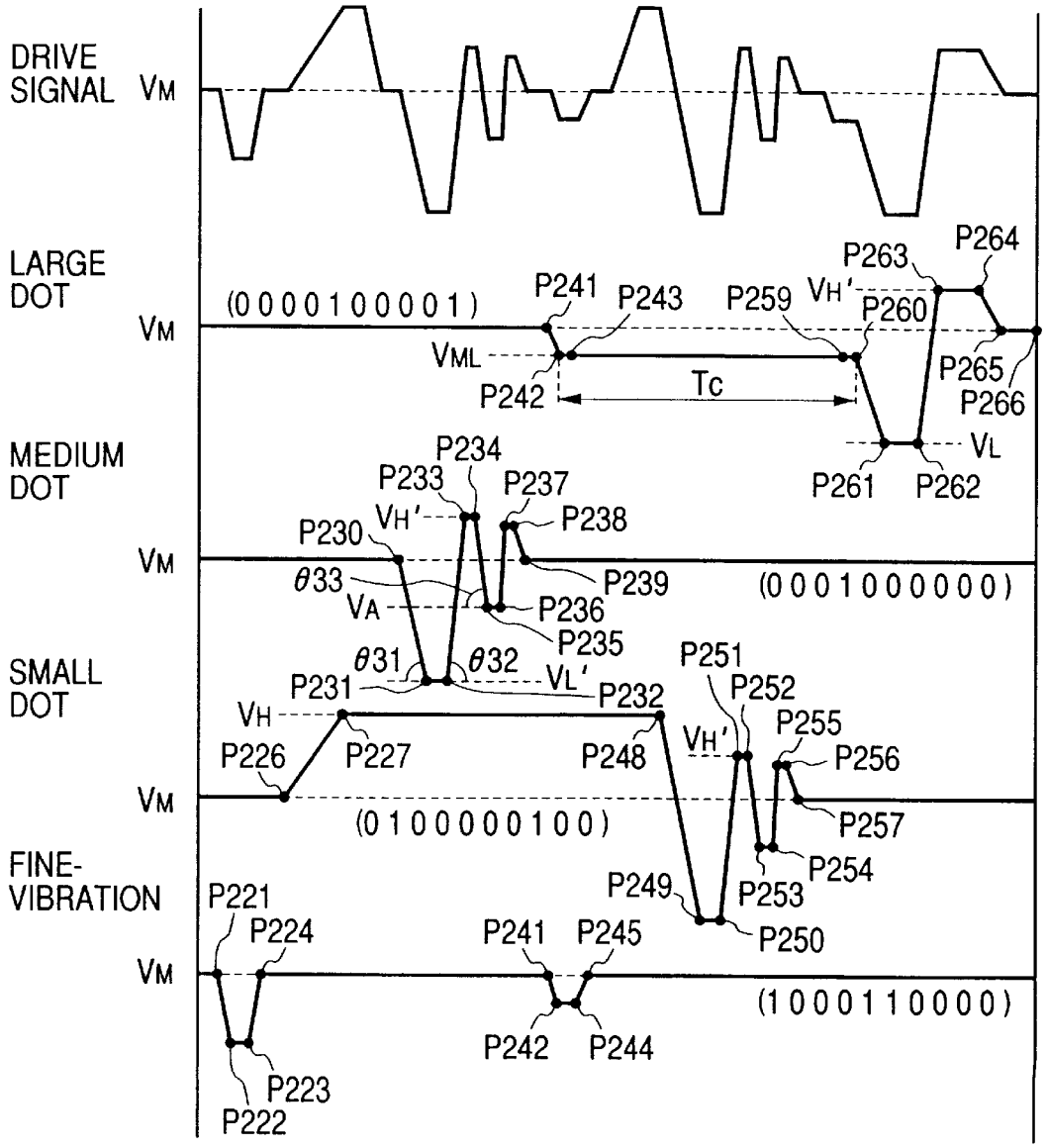
FIG. 16 is a waveform diagram showing drive pulses in the ninth embodiment of the present invention.

As shown in FIG. 16, the large-dot drive pulse, as a large-dot drive pulse in the fifth embodiment, includes expansion wave elements (P241 to P243, P259 to P260), a filling wave element (P260 to P262), an ejection wave element (P262 to P264), and a damp wave element (P264 to P265). The expansion wave elements slightly expands the pressure generating chamber 31 so as to charge some amount of ink into the pressure generating chamber 31, and holds this expanded state of the pressure generating chamber for predetermined time period. The filling wave element further expands the pressure generating chamber 31 already expanded by the expansion wave element to fill ink to the pressure generating chamber 31. The ejection wave element ejects an ink drop through the nozzle orifice 13 by abruptly increasing the signal voltage to a second highest voltage VH', slightly lower than the highest voltage VH. The damp wave element damps a fluctuation of the meniscus occurring immediately after the ejection.

The medium-dot drive pulse includes a filling wave element (P230 to P232), an ejection wave element (P232 to P234) for contracting the pressure generating chamber 31, a pull-in wave element (P234 to P236), and a damp wave element (P236 to P239). The filling wave element expands the pressure generating chamber 31 by decreasing to a second lowest voltage VL' (slightly higher than the lowest voltage VL) at a gradient θ31. The expanded state of the pressure generating chamber is held for a predetermined time period (P231 to P232). The ejection wave element contracts the pressure generating chamber 31 by increasing the voltage from VL' to VH' at a gradient θ32. The contracted state of the pressure generating chamber is held for a predetermined time period (P233 to P234). The pull-in wave element pulls the meniscus to the pressure generating chamber 31 by abruptly expanding the pressure generating chamber 31 just before a part of ink to be an ink drop by the application of the ejection wave element is separated from the meniscus. The damp wave element damps a fluctuation of the meniscus occurring immediately after the ejection.

The small-dot drive pulse includes contraction wave elements (P226 to P228, P247 to P248), a filling wave element (P248 to P250), an ejection wave element (P250 to P252), a pull-in wave element (P252 to P254), and a damp wave element (P254 to P257). The contraction wave element slightly contracts the pressure generating chamber 31 by increasing the signal voltage from the medium voltage VM to the highest voltage VH and holds this contracted state of the pressure generating chamber for a predetermined time period. The filling wave element expands the pressure generating chamber 31 contracted by the contraction wave element to fill ink to the pressure generating chamber. The ejection wave element contracts the expanded pressure generating chamber 31. The pull-in wave element pulls the meniscus to the pressure generating chamber 31 by abruptly expanding the pressure generating chamber 31 just before a part of ink to be an ink drop by the application of the ejection wave element is separated from the meniscus. The damp wave element damps a fluctuation of the meniscus occurring immediately after the ejection.

The in-print fine vibration pulse contains a first fine vibration wave element (P221 to P224) and a second fine vibration wave element (P241 to P245).

The ninth embodiment can eject a large ink drop of a large volume by applying the large-dot drive pulse to the piezoelectric vibrator 25, as in the fifth embodiment.

When the medium-dot drive pulse is applied to the piezoelectric vibrator 25, an ink drop is jetted in the following way. The voltage of the drive pulse is decreased from the medium voltage VM to the second lowest voltage VL' at such a gradient θ31 so as not to eject an ink drop (P230 to P231). The second lowest voltage VL' is held for a predetermined time period (P231 to P232). The result is to fill ink into the pressure-generating chamber 31. The signal voltage is abruptly increased from the lowest voltage VL to the second highest voltage VH' at a gradient θ32 (P232 to P234). At this time, the pressure generating chamber 31 rapidly contracts, while an ink pressure within the pressure. generating chamber rises. With rise of the ink pressure, a central part of the meniscus is curved upward. The signal voltage descends to a pull-in voltage VA at a gradient θ33 just before a part of ink to be an ink drop is separated from the meniscus (P234 to P235). As a result, the pressure generating chamber 31 is abruptly expanded, a negative pressure is set up in the chamber, and the circumferential edge of the meniscus is pulled into the pressure generating chamber 31. The central part of the meniscus is separated from the meniscus and jetted in the form of an ink drop. After the ink drop ejection, the increased voltage is decreased again to contract and expand the pressure generating chamber 31 to quicken the settling down of the fluctuation of the meniscus (P236 to P239).

When the small-dot drive pulse is applied to the piezoelectric vibrator 25, the signal voltage is increased from the medium voltage VM to the highest voltage VH, and the voltage VH is held for a predetermined time period (P226 to P228, P247 to P248) in order to attain a margin for expansion. Subsequently, an operation similar to that of the medium-dot drive pulse will be performed. Where the small-dot drive pulse is used, an ink drop is jetted in a state that the meniscus is deeply pulled into the pressure generating chamber. Therefore, a much smaller ink drop is jetted.

When the fine vibration drive pulse is applied to the piezoelectric vibrator 25, the first and second fine drive pulses a little expand the pressure generating chamber 31, so that its volume is somewhat larger than the reference volume defined by the medium voltage VM. After this state is held for a predetermined time period, the volume of the pressure generating chamber 31 is returned to the reference volume. In turn, the meniscus is a little pulled to the pressure generating chamber 31 and returned to its stationary state. Therefore, ink is agitated around the nozzle orifice 13.

A tenth embodiment of the present invention will be described. A waveform of a drive signal configured in the tenth embodiment is such that a small-dot ejection wave element serving as an other-dot ejection wave element is arranged between two large-dot ejection wave element waveforms of which are the same with each other.

Figure 17:
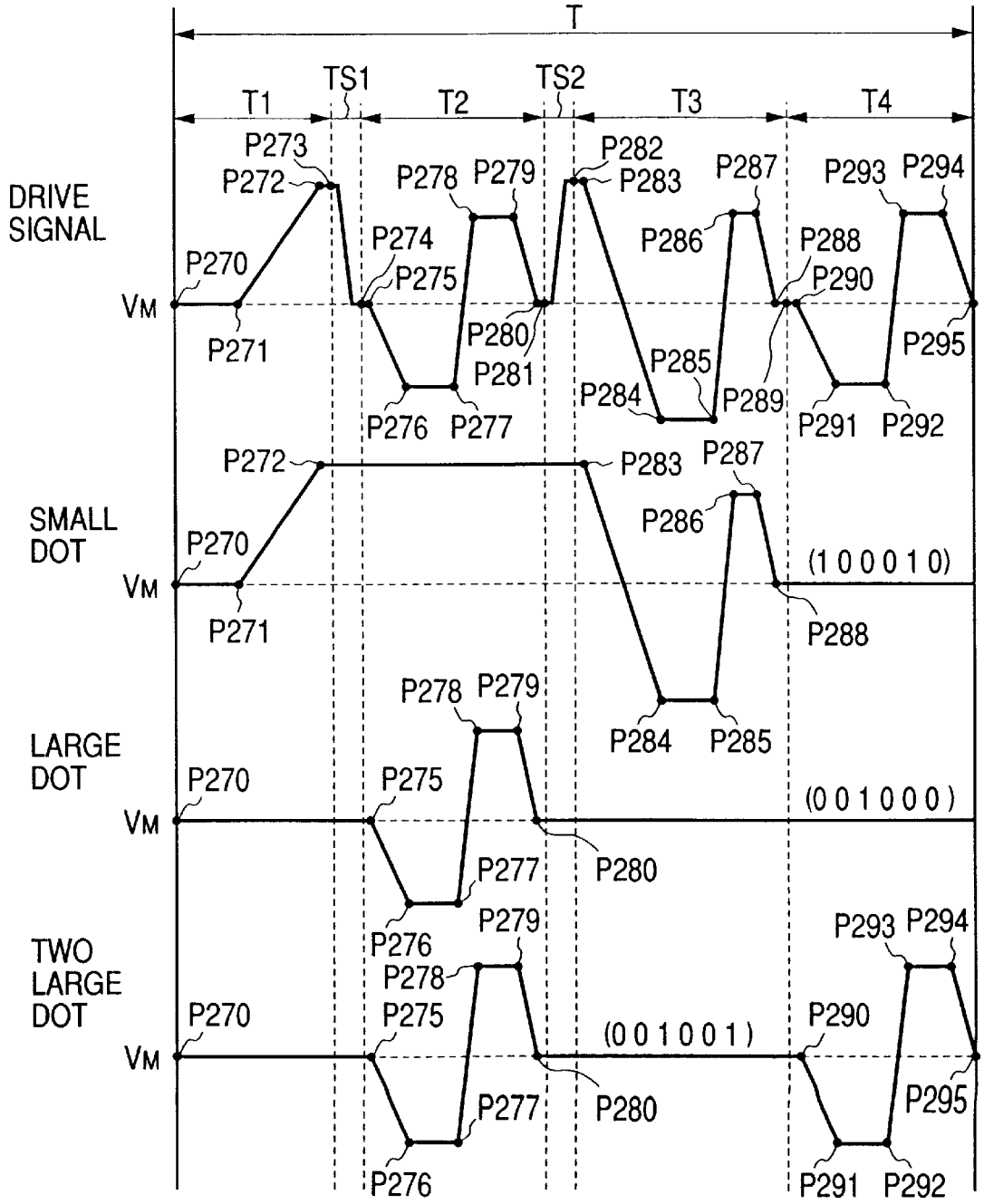
FIG. 17 is a waveform diagram showing a drive signal and drive pulses in a tenth embodiment of the present invention.

In the drive signal as shown in FIG. 17, a first wave element is located in a period T1 (P270 to P273), a second wave element is located in a period T2 (P274 to P281), a third wave element is located in a period T3 (P282 to P289), a fourth wave element is located in a period T4 (P289 to P295), a first connection element is located in a period TS1 (P273 to P274), and a second connection element is located in a period TS2 (P281 to P282).

The first wave element includes a contraction wave element (P271 to P272). The second wave element includes a first filling wave element (P275 to P277), a first large-dot ejection wave element (P277 to P279) and a first damp wave element (P283 to P285). The third wave element includes a second filling wave element (P283 to P285), a small-dot ejection wave element (P285 to P287) and a second damp wave element (P287 to P288). The fourth wave element includes a third filling wave element (P290 to P292), a second large-dot ejection wave element (P292 to P294) and a third damp wave element (P294 to P295).

The second and fourth wave elements in this embodiment have the same waveforms. Time period from a start point of the first wave element (P270) to an end point of the first damp wave element (P280) is identical with time period from the end point of the first damp wave element (P280) to a start point of a third damp wave element (P295). The end point of the third damp wave element (P295) is a start point of a first wave element (P270) in the next printing period T.

In order to generate a small-dot drive pulse from the drive signal, the drive pulse generator (selection signal generating section 22, level shifter 23 and switch circuit 24) selects the first and third wave elements therefrom and connects the selected wave elements. Specifically, the drive pulse generator selects the above wave elements based on print data of "100010". In a case where the drive pulse generator generates a large-dot drive pulse, the second wave element is selected base on print data of "001000" or the fourth wave element is selected based on print data of "000001". Namely, the second and fourth wave elements can separately form the large-dot drive pulse in this embodiment.

In a case where large ink drops are serially ejected, the drive pulse generator selects both of the second and fourth wave elements based on print data of "001001" to generate two large-dot drive pulses. As described above waveforms of the former large-dot drive pulse (P275 to P280) and the latter large-dot drive pulse (P290 to P295) are identical with each other. And the time period from the start point of the driving period T (P270) to the start point of the former large-dot drive pulse (P275) and the time period from the end point of the former large-dot drive pulse (P280) to the start point of the latter large-dot drive pulse (P290) are identical with each other. Namely, the time period from the end point of one large-dot drive pulse to the start point of next large-dot drive pulse is made constant.

Whereby, in the above case, the large ink drop can be ejected at a constant period, viz. a constant frequency. Accordingly, deviation of the landing position of the ink drops ejected by the former and latter large-dot drive pulses can be reduced, and thereby the print quality can be improved. Further, the recording head 8 can be driven with a frequency as high as possible. In this embodiment, the drive signal is generated with the recording period T of 10.8 kHz, for instance. According to the above configuration, since two large ink drops can be ejected within the recording period T, the substantial driving frequency of the recording head 8 can be increased.

Further, since the ejection wave element forming the small-dot drive pulse, which serves as the other-dot wave element, is arranged between the two ejection wave elements composing large-dot wave element, more drive waveforms can be contained within the limited recording period T.

Still further, since the waveforms of the two large-dot drive pulses are identical with each other, the ink drop having same volume can be ejected by any of large-dot drive pulses. Namely, the large dots having same size can be attained.

Although two large-dot drive pulses are included within the recording period T in this embodiment, more large-dot drive pulses may be included therein.

There will be described an eleventh embodiment of the present invention which allows large ink drops, medium-ink drops and small ink drops are jetted from an identical nozzle orifice 13. In this embodiment, waveforms of two large-dot ejection wave elements forming a large-dot drive pulse are identical with each other. The large-dot ejection wave elements are arranged in a drive signal so as to appear at constant timing in a recording period. A small-dot ejection wave element is arranged between the large-dot ejection wave elements.

Figure 18:
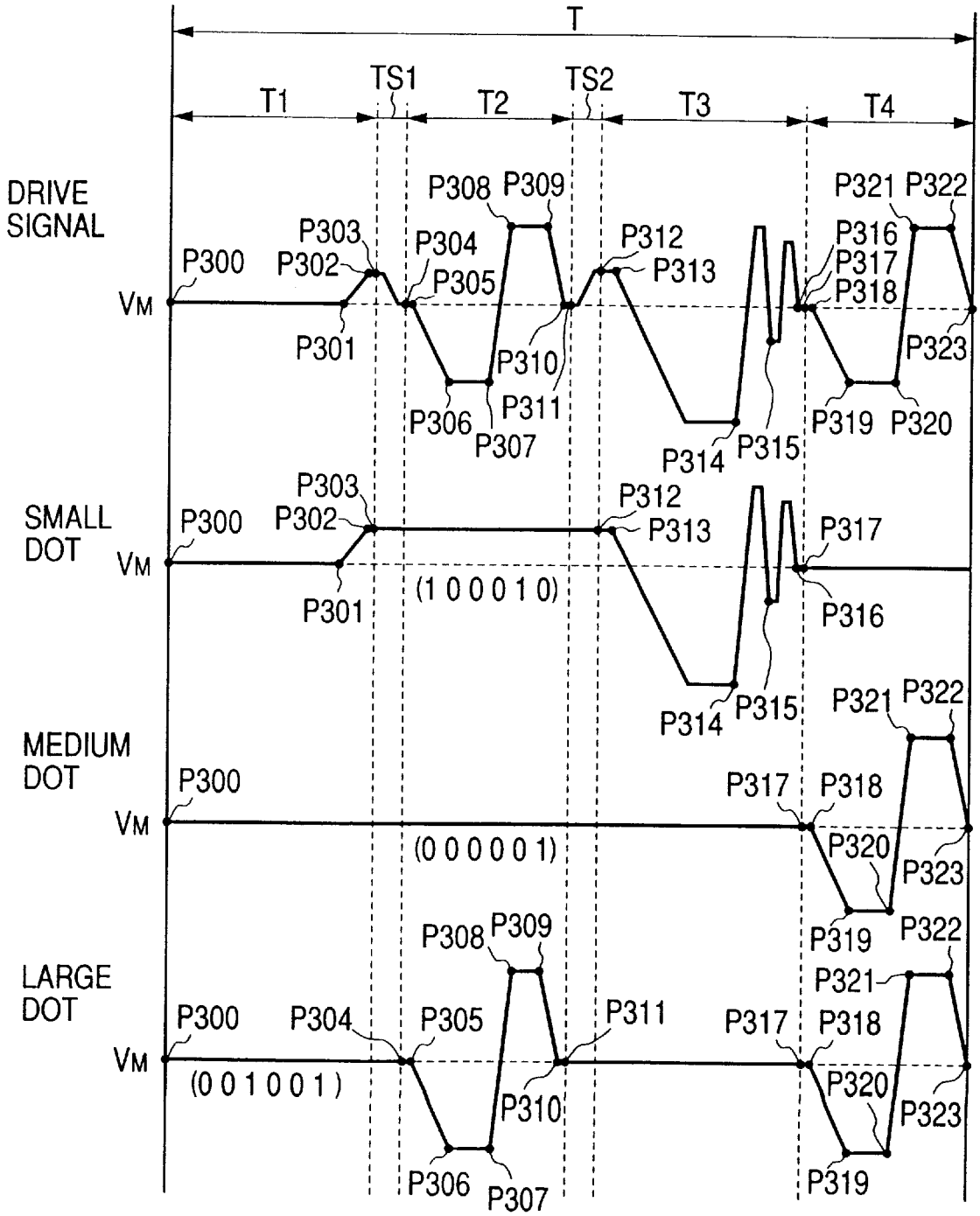
FIG. 18 is a waveform diagram showing a drive signal and drive pulses in an eleventh embodiment of the present invention.

In a drive signal as shown in FIG. 18, a first wave element is located in a period T1 (P300 to P303), a second wave element is located in a period T2 (P304 to P311), a third wave element is located in a period T3 (P312 to P317), a fourth wave element is located in a period T4 (P317 to P323), a first connection element is located in a period TS1 (P303 to P304), and a second connection element is located in a period TS2 (P311 to P312).

The first wave element includes a contraction wave element (P301 to P302). The second wave element includes a first filling wave element (P305 to P307), a first ejection wave element (P307 to P309) and a first damp wave element (P309 to P310). The third wave element includes a second filling wave element (P313 to P314), a second ejection wave element (P314 to P315) and a second damp wave element (P315 to P316). The fourth wave element includes a third filling wave element (P318 to P320), a third ejection wave element (P320 to P322) and a third damp wave element (P322 to P323). The end point of the third damp wave element (P323) is a start point of a first wave element (P300) in the next printing period T.

In order to generate a small-dot drive pulse from the drive signal, the drive pulse generator (selection signal generating section 22, level shifter 23 and switch circuit 24) selects the first and third-wave elements therefrom and connects the selected wave elements. Specifically, the drive pulse generator selects the above wave elements based on print data of "100010". In the small-dot drive pulse, the second ejection wave element (P314 to P315) of the third wave element serves as an other-dot drive pulse of the present invention.

In a case where the drive pulse generator generates a medium-dot drive pulse from the drive signal, the drive pulse generator selects the fourth wave element based on print data of "000001". Namely, the fourth wave element independently forms the medium-dot drive pulse.

In a case where the drive pulse generator generates a large-dot drive pulse, the drive pulse generator selects both of the second and fourth wave elements based on print data of "001001" and connects them. In the large-dot drive pulse, the first ejection wave element (P307 to P309) of the second wave element and the third ejection wave element (P320 to P322) of the fourth wave element serve as a large-dot ejection wave element.

As described above, waveforms of the former large-dot drive pulse (P305 to P310) and the latter large-dot drive pulse (P318 to P323) are identical with each other. And the time period from the start point of the driving period T (P300) to the start point of the former large-dot drive pulse (P305) and the time period from the end point of the former large-dot drive pulse (P310) to the start point of the latter large-dot drive pulse (P318) are identical with each other. Namely, the time period from the end point of one large-dot drive pulse to the start point of next large-dot drive pulse is made constant.

In this embodiment, the small-dot ejection wave element (P313 to P316) forming the small-dot driving pulse is arranged between the large-dot ejection wave elements. According to this configuration, in the bi-directional printing in which printing is executed in both of former and latter action of reciprocate movement of the recording head 8 (the carriage), landing position of the small and large ink drops can be aligned by aligning the landing position of the large ink drop with reference to the landing position of the small ink drop ejected by the small-dot drive pulse.

Further, since the waveforms of the two large-dot drive pulses are identical with each other, the ink drop having same volume can be ejected by any of large-dot drive pulses. Namely, the large dots having same size can be attained.

Still further, since the large-dot ejection wave elements are arranged so as to appear at a constant period in the recording period T, in the bi-directional printing, the same recording condition can be attained in both of the former and latter action of the reciprocate movement.

In view of the above, according to the present invention, high quality image can be recorded especially in the bi-directional printing.

Figure 19:
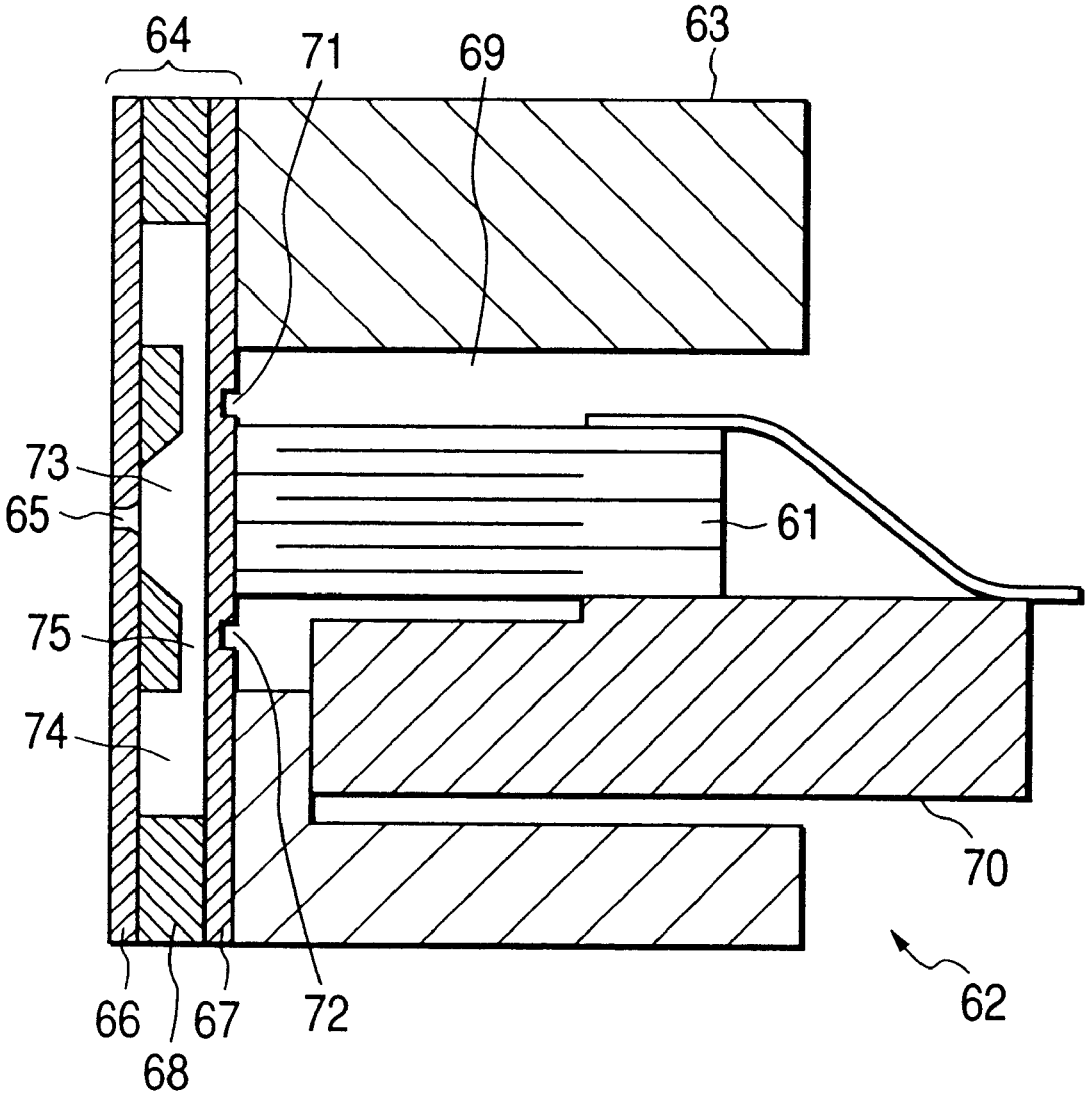
FIG. 19 is a sectional view showing another type of a recording head that may be applied to the present invention.

While the piezoelectric vibrator 25 used for the pressure generating elements of the recording head 8 is of the flexural vibration type in the above-mentioned embodiments, the piezoelectric vibrator may be of the vertical vibration type. An example of the piezoelectric vibrator operable in the longitudinal vibration mode is shown in FIG. 19. In the figure, the piezoelectric vibrator is designated by reference numeral 61, and the recording head is designated by reference numeral 62.

The recording head 62 is made up of a synthetic resin base member 63 and a channel unit 64 bonded to the front face (left side in the drawing) of the base member 63. The channel unit 64 includes a nozzle plate 66 on which nozzle orifices 65 are formed, a vibration plate 67 and a channel forming plate 68.

The base member 63 is a block like member having a space 69 opened to the front and rear faces. A piezoelectric vibrator 61 fixed on a substrate 70 is accommodated within the space 69.

The nozzle plate 66 is a thin plate with a number of nozzle orifices 65 arrayed in the subscanning direction. The nozzle orifices 65 are arrayed at predetermined pitches, which correspond to a dot forming density. The vibrating plate 67 includes island portions 71, each provided so as to be associated with a nozzle orifice 65 at predetermined pitch. Each island portion 71 forms a thick part against which the piezoelectric vibrator 61 is abutted, and an elastic thin portion 72 provided surrounding the island portion 71.

The channel forming plate 68 includes pressure generating chambers 73, common ink reservoir 74, and openings for forming ink channels 75 communicating the pressure generating chambers 73 with the ink reservoir 74.

The nozzle plate 66 is placed on the front face of the channel forming plate 68 and the vibration plate 67 is placed on the rear face of the vibration plate 67. The channel forming plate 68 is sandwiched between the nozzle plate 66 and the vibration plate 67, and the thus combined those members are bonded together into the channel unit 64.

In the channel unit 64, the pressure generating chambers 73 are formed on the rear side of the nozzle orifice 65, and the island elements 71 of the vibration plate 67 are located on the rear side of the pressure generating chamber 73. A communication is set up between the pressure generating chambers 73 and the ink reservoir 74 by the ink channels 75.

The top end of the piezoelectric vibrator 61 is brought into contact with the rear side of the island portion 71, and in this state the piezoelectric vibrator 61 is fixed to the base member 63. The piezoelectric vibrator 61 is supplied with a drive signal COM and print data SI through a flexible cable.

The piezoelectric vibrator 61 of the longitudinal vibration type contracts in the direction perpendicular to the direction of a charging electric field applied thereto, and expands in the direction perpendicular to the direction of a discharging electric field applied. When a charging electric field is set up, the piezoelectric vibrator 61 of the recording head 62 contracts rearwardly; with the contraction, the island portion 71 is pulled rearwardly; and the contracted pressure generating chamber 73 is expanded. With the expansion, ink is supplied from the common ink chamber 74 to the pressure generating chamber 73 via the ink passage 75. When a discharging electric field is set up, the piezoelectric vibrator 61 expands forwardly; the island portion 71 of the elastic plate is pushed forwardly; and the pressure generating chamber 73 contracts. With the contraction, an ink pressure within the pressure generating chamber 73 increases.

Figure 20:
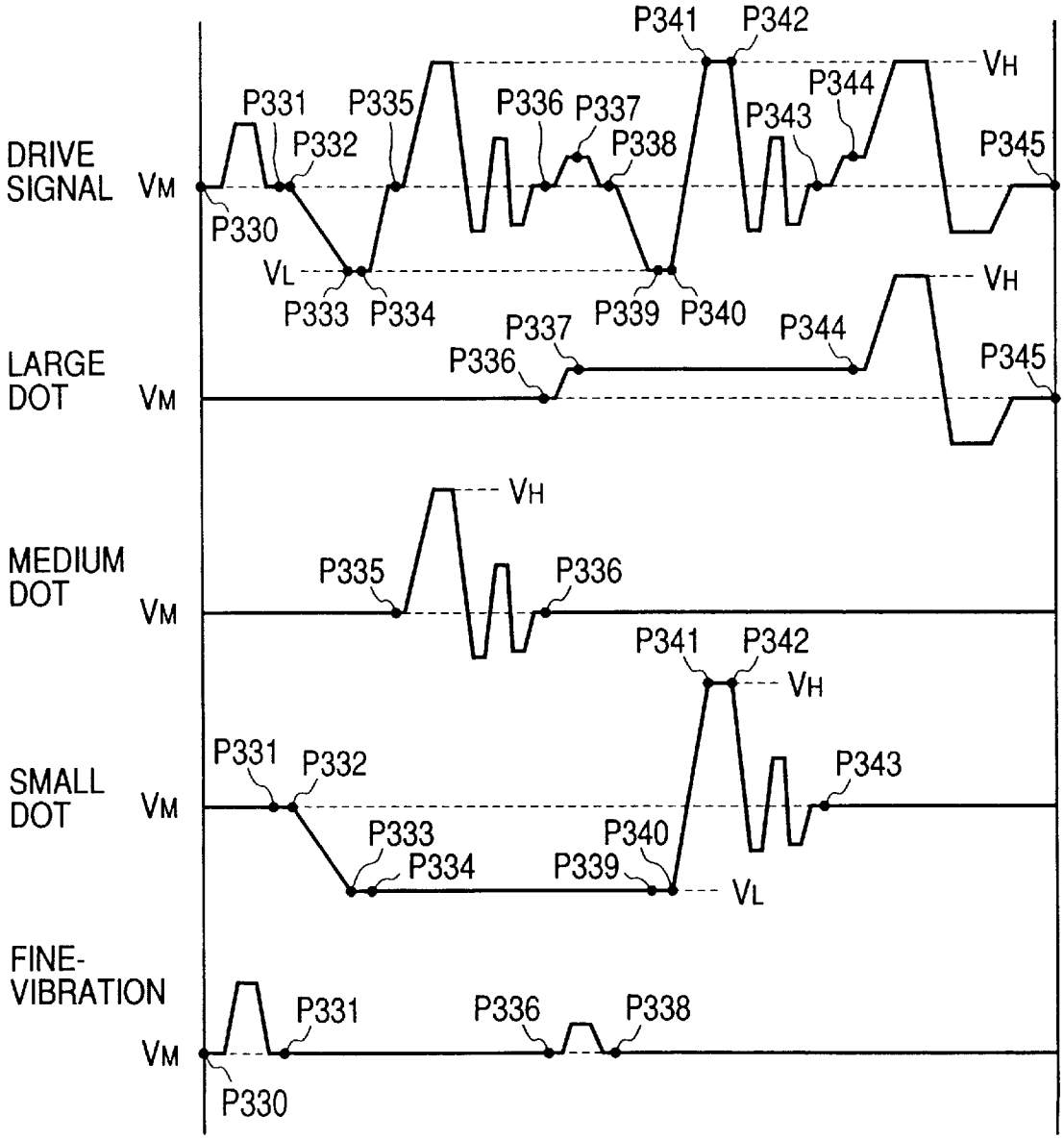
FIG. 20 is a waveform diagram showing a drive signal and drive pulses, which are used for driving the recording head of FIG. 19.

As seen, in the recording head 62, the relationships of the expansion/contraction to the charging/discharging of the piezoelectric vibrator 61 is reverse to those in the above-mentioned embodiments. Therefore, where the recording head 62 is used, the polarities of the drive signals and the drive pulses are inverse to those of the above-mentioned embodiments with respect to the medium voltage. An example of this is illustrated in FIG. 20. As shown, the polarities of the drive signal and the drive pulses are inverse to those in FIGS. 15 and 16 with respect to the medium voltage VM.

In the recording head 62, ink is charged into the pressure generating chambers 73 by increasing the drive signal voltage. An ink drop is jetted by decreasing the signal voltage. It is evident that the use of the recording head 62 produces the useful effects as the above-mentioned one.

In the drive signal of FIG. 20, the lowest voltage VL is within 0V (ground level) and about 5V. The end point of the first half portions (P332 to P334 and P339 to P340) of contraction wave elements where the signal voltage descends from the medium voltage VM is set at the lowest voltage VL. The end point of the first half of the contraction wave element and the start point of the wave element forming the medium-dot drive pulse (P335 to P336) are mutually connected by a connection element (P334 to P335).

When the lowest voltage VL is set within the above range (0V to about 5V), the drive signal may be constructed by use of voltage varying from ground potential in the positive direction. This contributes to simplification of the control. Additionally, when the highest voltage VH is applied and held, the voltage level of the highest voltage VH may be reduced. This remarkably reduces stress imposed on the piezoelectric vibrator when the voltage is applied thereto.

As seen from the foregoing description, drive pulse generator generates a drive signal containing wave elements capable of driving a piezoelectric vibrator and wave elements incapable of driving the piezoelectric vibrator, and connection elements each connecting wave elements of which voltage levels are different. The drive pulse generator appropriately selects those wave elements and composes them into drive pulses. Those drive pulses are applied to the piezoelectric vibrator-to eject an ink drop or drops. Since the connection element is incapable of driving the piezoelectric vibrator, the voltage variation gradient of the drive signal may be sharp.

A time taken to connect the wave elements of which the connection ends are at different voltage levels can be remarkably shorten. Therefore, an increased number of wave elements may be confined into a drive signal within a print period, even if the voltage varying gradation and timings of those wave elements are determined in connection with the pressure generating element.

A range within which the size of the ink drop is variable may be broadened if the wave elements are properly selected. Therefore, ink drops of various sizes can be jetted at high printing speed.

When it is configured that: a drive pulse generator generates a drive pulse containing a wave element which expands a pressure generating chamber; holds the expanded state of the pressure generating chamber for a predetermined time period; further expands the expanded pressure generating chamber; and contracts the pressure generating chamber to eject an ink drop, a negative pressure is set up in the pressure generating chamber when the pressure generating chamber is expanded, and after the holding time, a normal pressure is set up again in the pressure generating chamber.

Since the pressure generating chamber of which the internal pressure is now normal is slightly expanded, a pressure variation within the pressure generating chamber when ink is charged into the pressure generating chamber can be lessened, to restrict the retraction of the meniscus.

When an ink drop of a large volume is jetted, an internal pressure of the ink chamber may be varied more broadly. This feature prevents a flying velocity of an ink drop from excessively increasing.

The flying velocity of the ink drop may be adjusted by properly setting a degree of expansion of the pressure generating chamber and the time of holding the expanded state of the pressure generating chamber. Therefore, the flying velocity of the ink drop may be selected appropriate to the ink drop ejection. Difference of the flying velocities of the jetted ink drops may be reduced.

What is claimed is:

1. An ink jet recording apparatus comprising:

a recording head including a pressure generating element provided in association with the pressure generating chamber communicating with a nozzle orifice, an ink drop is jetted from the nozzle orifice by applying a drive pulse to the pressure generating element;

drive signal generating means for generating a drive signal; and drive pulse generating means for generating a drive pulse from the drive signal;

wherein the drive signal generated by the drive signal generating means contains wave elements capable of activating the pressure generating element and a connection element made incapable of activating the pressure generating chamber and for connecting connection ends of the wave elements having different voltage levels, and wherein the drive pulse generating means appropriately selects the wave elements, except for never selecting the connection element, in the drive signal and composes them into the drive pulse.

2. The ink jet recording apparatus as set forth in claim 1, wherein the time period of the voltage-gradient portion of the connection element is not longer than that of the wave elements.

3. The ink jet recording apparatus as set forth in claim 1, wherein the wave elements include a plurality of ejection wave elements capable of driving the pressure generating element to eject an ink drop, and wherein the connection element interconnects the ejection wave elements.

4. The ink jet recording apparatus as set forth in claim 3, wherein the wave elements include a filling wave element capable of driving the pressure generating element to fill ink into the pressure generating chamber, and wherein the drive pulse generating means generates a plurality kinds of drive pulses at the time of selecting the ejection wave element and the filling wave element.

5. The ink jet recording apparatus as set forth in claim 1, wherein the wave elements include a plurality of ejection wave elements capable of driving the pressure generating element to eject ink drops at different timings, and wherein the drive pulse generating means generates a plurality of drive pulses such that an ink drop forming a small-volume dot is ejected earlier than an ink drop forming a large-volume dot.

6. The ink jet recording apparatus as set forth in claim 1, wherein the wave elements include a plurality of ejection wave elements capable of driving the pressure generating element to eject ink drops at different timings, wherein the drive pulse generating means generates a small-dot drive pulse capable of ejecting a small ink drop to form a small-volume dot, a medium-dot drive pulse capable of ejecting a medium ink drop to form a medium-volume dot, and a large-dot drive pulse capable of ejecting a large ink drop to form a large-volume dot, and wherein either one of large- or medium-dot drive pulses is located before an ejection wave element of a small-dot drive pulse on the time axis, and the other one is located after an ejection wave element of a small-dot drive pulse on the time axis.

7. The ink jet recording apparatus as set forth in claim 1, wherein the wave elements include first and second large-dot ejection wave elements capable of forming a large-volume dot, and an other-dot ejection wave element for ejecting an ink drop to form a dot having a size other than the large-volume dot, wherein at least the other-dot ejection wave element is located between the first and second large-dot ejection wave elements, and wherein the drive pulse generating means generates a drive pulse containing the first and second large-dot ejection wave elements.

8. The ink jet recording apparatus as set forth in claim 1, wherein the wave elements include a plurality of large-dot ejection wave elements for respectively ejecting a large ink drop forming a large-volume dot and an other-dot ejection wave element for ejecting an ink drop forming a dot having a size other than the large-volume dot, which is arranged between the large-dot ejection wave elements, and wherein the drive pulse generating means generates a drive pulse composed of at least one ejection wave element.

9. The ink jet recording apparatus as set forth in claim 8, wherein the waveforms of the plurality of large-dot ejection wave elements are substantially the same with each other.

10. The ink jet recording apparatus as set forth in claim 8 or 9, wherein two large-dot ejection wave elements are arranged in the drive signal so as to appear at constant interval.

11. The ink jet recording apparatus as set forth in claim 1, wherein the wave elements include a plurality of filling wave elements capable of driving the pressure generating element to fill ink into the pressure generating chamber, and an ejection wave element capable of driving the pressure generating element to eject an ink drop, wherein the connection element interconnects the filling wave elements, and wherein the drive pulse generating means generates a drive pulse containing one selected filling wave element and an ejection wave element.

12. The ink jet recording apparatus as set forth in claim 1, wherein the connection element includes constant voltage portions at both ends coupled to the wave element.

13. An ink jet recording apparatus comprising:

a pressure generating element for expanding and contracting the pressure generating chamber in response to a drive pulse to vary an ink pressure within the pressure generating chamber in order to eject an ink drop from a nozzle orifice associated with the pressure generating chamber;

drive signal generating means for generating a drive signal; and drive pulse generating means for generating a drive pulse from the drive signal, the drive pulse generating means generating a first drive pulse containing an expansion wave element for expanding the pressure generating chamber and holding the expanded state of the pressure generating chamber, a first filling wave element for further expanding the pressure generating chamber expanded by the expansion wave element, and a first ejection wave element for contracting the pressure generating chamber expanded by the first filling wave element, wherein the expansion wave element and the first filling wave element cause potential change of the first drive pulse without crossing over a reference potential which is identical with an initial potential and a termination potential of the drive signal; and wherein the potential change caused by the expansion wave element and the first filling wave element is smaller than a potential change caused by the first ejection wave element.

14. The ink jet recording apparatus as set forth in claim 13, wherein a time period for holding the expanded state of the pressure generating chamber is longer than the period of a natural period of the pressure generating chamber.

15. The ink jet recording apparatus as set forth in claim 13, wherein the drive pulse generating means generates a second drive pulse containing a contraction wave element for contracting the pressure generating chamber and holding the contracted state of the pressure generating chamber, a second filling wave element for expanding the pressure generating chamber contracted and held by the contraction wave element to fill ink therein, and a second ejection wave element for contracting the pressure generating chamber expanded by the second filling wave element to eject an ink drop.

16. The ink jet recording apparatus as set forth in claim 13, wherein the expansion wave element consists of stepwise expansion wave elements for stepwise expanding the pressure generating chamber.

17. The ink jet recording apparatus as set forth in claim 13, wherein the contraction wave element consists of stepwise contraction wave elements for stepwise contracting the pressure generating chamber.

18. The ink jet recording apparatus as set forth in claim 13, wherein at least one of the drive pulses is divided into a plurality of wave elements in the drive signal, wherein at least one other wave element for forming other drive pulse is located among the divided wave elements, and wherein the drive pulse generating means selectively composes the divided wave elements into a drive pulse.

19. The ink jet recording apparatus as set forth in claim 13, wherein the expansion wave element, which is to constitute at least one of the drive pulses, is divided into a plurality of expansion segments, and wherein at least one ejection wave element, which is to constitute at least one other drive pulse, is located among the divided expansion segments to form the drive signal.

20. The ink jet recording apparatus as set forth in claim 13, wherein the contraction wave element, which is to constitute at least one of the drive pulses, is divide d into a plurality of contraction segments, and wherein at least one other ejection wave element, which is to constitute at least one other drive pulse, is located among the divided contraction segments to form the drive signal.

21. The ink jet recording apparatus as set forth in any of claims 18 to 20, wherein an expansion segment constituting a part of the expansion wave element is located the front part of the drive signal, and wherein the first ejection wave element is located at the end part of the drive signal.

22. The ink jet recording apparatus as set forth in any of claims 18 to 20, wherein different voltage levels of the divided wave elements are mutually connected by the connection element.

23. The ink jet recording apparatus as set forth in claim 21, wherein different voltage levels of the divided wave elements are mutually connected by the connection element.

24. The ink jet recording apparatus as set forth in claim 1 or 13, wherein the pressure generating element is a piezoelectric vibrator of the flexural vibration type.

25. The ink jet recording apparatus as set forth in claim 1 or 13, wherein the pressure generating element is a piezoelectric vibrator of the longitudinal vibration type.

26. The ink jet recording apparatus as set forth in claim 1 or 13, wherein the pressure generating element includes a piezoelectric vibrator of the longitudinal vibration type, and an end point of the wave element for decreasing the voltage from a medium voltage is set at a voltage level within a range of 5V from a ground potential and connected to the connection element.

27. The recording apparatus as set forth in claim 13, wherein at least one wave element is placed between the expansion wave element and the first filling wave element in the drive signal.

28. A method of driving an ink jet recording apparatus comprising the steps of:

generating a drive signal containing wave elements and at least one connection element which connects connection ends of the wave elements having different potentials;

selecting wave elements except for never selecting the connection element;

composing the selected wave elements into a drive pulse; and applying the generated drive pulse to a pressure generating element to eject an ink drop.

29. A method of driving an ink jet recording apparatus comprising the steps of:

generating a drive signal which includes at least a first wave element for expanding a pressure generating chamber, and a second wave element for further expanding the expanded pressure generating chamber such that the first wave element and the second wave element cause potential change without crossing over a reference voltage which is identical to an initial potential and a termination potential of the drive signal; and applying the drive signal to a pressure generating element to expand the pressure chamber stepwise.

* * * * *